US009114654B2

(12) United States Patent
Cyman, Jr. et al.

(10) Patent No.: US 9,114,654 B2
(45) **Date of Patent: *Aug. 25, 2015**

(54) SYSTEMS AND METHODS FOR HIGH SPEED VARIABLE PRINTING

(75) Inventors: Theodore F. Cyman, Jr., Grand Island, NY (US); Anthony B. DeJoseph, East Amherst, NY (US); Kevin J. Hook, Grand Island, NY (US); Henk Haan, North Tonawanda, NY (US); Anthony V. Moscato, North Tonawanda, NY (US)

(73) Assignee: R.R. Donnelley & Sons Company, Chicago, IL (US)

( * ) Notice: Subject to any disclaimer, the term of this patent is extended or adjusted under 35 U.S.C. 154(b) by 367 days.

This patent is subject to a terminal disclaimer.

(21) Appl. No.: 11/709,599

(22) Filed: Feb. 21, 2007

(65) Prior Publication Data

US 2007/0199462 A1 Aug. 30, 2007

Related U.S. Application Data

(60) Provisional application No. 60/775,511, filed on Feb. 21, 2006, provisional application No. 60/819,301, filed on Jul. 7, 2006.

(51) Int. Cl.
*B41F 7/00* (2006.01)
*B41M 1/06* (2006.01)
(Continued)

(52) U.S. Cl.
CPC ..... *B41M 1/06* (2013.01); *B41C 1/105* (2013.01); *B41C 1/1066* (2013.01); *B41F 7/00* (2013.01);
(Continued)

(58) Field of Classification Search
CPC ..... B41F 19/007; B41F 7/00; B41F 7/30; B41F 33/0054; B41C 1/105; B41C 1/1066; B41M 1/06; B41P 2227/70
USPC ..... 101/130, 147, 450.1, 451, 463.1, 465, 101/466; 347/103
See application file for complete search history.

(56) References Cited

U.S. PATENT DOCUMENTS 778,892 A 1/1905 Read
1,766,957 A 6/1930 Smith
(Continued)

FOREIGN PATENT DOCUMENTS

CA 2 392 730 10/2003
CN 1383992 12/2002
(Continued)

OTHER PUBLICATIONS

International Preliminary Report on Patentability dated Sep. 4, 2008, International Application No. PCT/US2007/004437 International filing date Feb. 21, 2007.
(Continued)

*Primary Examiner* — Blake A Tankersley
(74) *Attorney, Agent, or Firm* — McCracken & Gillen LLC

(57) ABSTRACT

Systems and methods for high-speed variable printing are provided. Ink jet technology and lithographic systems may be combined in such a way to create a fully variable and high-quality print system. Ink is applied to a first cylinder. Aqueous solution is applied to a second cylinder to produce a negative image. At least a portion of the ink from the first cylinder is transferred to the second cylinder. A positive image in ink is then transferred from the second cylinder to a print medium, and residue ink and aqueous solution is cleaned from the second cylinder. The systems and methods described herein may be used to create high-quality one-to-one marketing applications.

35 Claims, 14 Drawing Sheets

(51) Int. Cl.

| | |
|---|---|
| ***B41C 1/10*** | (2006.01) |
| ***B41F 7/30*** | (2006.01) |
| ***B41F 33/00*** | (2006.01) |
| ***B41J 2/005*** | (2006.01) |
| ***B41J 29/17*** | (2006.01) |
| ***B41M 1/14*** | (2006.01) |

(52) U.S. Cl.

CPC ..... *B41F 7/30* (2013.01); *B41F 33/0054* (2013.01); *B41J 2/0057* (2013.01); *B41J 29/17* (2013.01); *B41M 1/14* (2013.01); *B41P 2200/13* (2013.01); *B41P 2200/22* (2013.01); *B41P 2227/70* (2013.01)

(56) References Cited

U.S. PATENT DOCUMENTS

| | | | | |
|---|---|---|---|---|
| 2,562,782 | A | | 7/1951 | Frost |
| 3,574,297 | A | | 4/1971 | Bozer |
| 3,589,289 | A | | 6/1971 | Gosnell |
| 3,741,118 | A | | 6/1973 | Carley |
| 3,790,703 | A | | 2/1974 | Carley |
| 3,800,699 | A | | 4/1974 | Carley |
| 3,869,986 | A | | 3/1975 | Hubbard |
| 3,986,452 | A | | 10/1976 | Dahlgren |
| 4,010,686 | A | | 3/1977 | Harris |
| 4,069,759 | A | | 1/1978 | Endo et al. |
| 4,368,669 | A | | 1/1983 | Love, III |
| 4,404,907 | A | | 9/1983 | Köbler et al. |
| 4,718,340 | A | | 1/1988 | Love, III |
| 4,729,310 | A | | 3/1988 | Love, III |
| 4,808,443 | A | | 2/1989 | Minamoto et al. |
| 4,833,486 | A | * | 5/1989 | Zerillo ..... 347/2 |
| 4,833,530 | A | | 5/1989 | Kohashi |
| 5,106,414 | A | | 4/1992 | Kunichika et al. |
| 5,129,321 | A | | 7/1992 | Fadner |
| 5,188,033 | A | | 2/1993 | Fadner |
| 5,202,206 | A | | 4/1993 | Tam |
| 5,221,330 | A | | 6/1993 | Matsumoto et al. |
| 5,294,946 | A | | 3/1994 | Gandy et al. |
| 5,312,654 | A | | 5/1994 | Arimatsu et al. |
| 5,333,548 | A | * | 8/1994 | Fadner ..... 101/467 |
| 5,366,000 | A | | 11/1994 | Reimann et al. |
| 5,389,958 | A | | 2/1995 | Bui et al. |
| 5,462,591 | A | | 10/1995 | Karandikar et al. |
| 5,476,043 | A | * | 12/1995 | Okuda et al. ..... 101/483 |
| 5,495,803 | A | | 3/1996 | Gerber et al. |
| 5,501,150 | A | | 3/1996 | Leenders et al. |
| 5,505,126 | A | * | 4/1996 | Ohno et al. ..... 101/147 |
| 5,511,477 | A | | 4/1996 | Adler et al. |
| 5,552,817 | A | | 9/1996 | Kuehnle |
| 5,554,212 | A | | 9/1996 | Bui et al. |
| 5,560,608 | A | | 10/1996 | Silverschotz |
| 5,644,981 | A | | 7/1997 | Ohno et al. |
| 5,681,065 | A | | 10/1997 | Rua, Jr. et al. |
| 5,697,297 | A | | 12/1997 | Rasmussen |
| 5,738,013 | A | | 4/1998 | Kellett |
| 5,765,083 | A | | 6/1998 | Shinohara |
| 5,809,893 | A | | 9/1998 | Gamperling et al. |
| 5,820,932 | A | | 10/1998 | Hallman et al. |
| 5,826,507 | A | | 10/1998 | Lim |
| 5,852,975 | A | | 12/1998 | Miyabe et al. |
| 5,881,644 | A | * | 3/1999 | Miyaguchi et al. ..... 101/450.1 |
| 5,906,156 | A | | 5/1999 | Shibuya et al. |
| 5,953,988 | A | | 9/1999 | Vinck |
| 5,966,154 | A | | 10/1999 | DeBoer |
| 5,969,740 | A | | 10/1999 | Maeda et al. |
| 6,002,904 | A | | 12/1999 | Yoshida et al. |
| 6,006,666 | A | | 12/1999 | Gottling |
| 6,050,193 | A | | 4/2000 | DeBoer et al. |
| 6,079,331 | A | | 6/2000 | Koguchi et al. |
| 6,079,806 | A | * | 6/2000 | Wen et al. ..... 347/10 |
| 6,082,263 | A | | 7/2000 | Koguchi et al. |
| 6,113,231 | A | | 9/2000 | Burr et al. |
| 6,120,665 | A | | 9/2000 | Chiang et al. |
| 6,125,750 | A | | 10/2000 | Achelpohl |
| 6,125,755 | A | | 10/2000 | Link et al. |
| 6,126,281 | A | | 10/2000 | Shimoda et al. |
| 6,131,514 | A | | 10/2000 | Simons |
| 6,152,037 | A | | 11/2000 | Ishii et al. |
| 6,164,757 | A | | 12/2000 | Wen et al. |
| 6,173,647 | B1 | | 1/2001 | Kakuta et al. |
| 6,187,380 | B1 | | 2/2001 | Hallman et al. |
| 6,196,129 | B1 | | 3/2001 | Kellett |
| 6,231,177 | B1 | | 5/2001 | Cherukuri et al. |
| 6,283,031 | B1 | | 9/2001 | Kakuta et al. |
| 6,283,589 | B1 | | 9/2001 | Gelbart |
| 6,295,928 | B1 | | 10/2001 | Heinzl et al. |
| 6,298,780 | B1 | | 10/2001 | Ben-Horin et al. |
| 6,315,916 | B1 | | 11/2001 | Deutsch et al. |
| 6,318,264 | B1 | * | 11/2001 | D'Heureuse et al. ..... 101/467 |
| 6,341,559 | B1 | | 1/2002 | Riepenhoff et al. |
| 6,354,207 | B1 | | 3/2002 | Maekawa et al. |
| 6,367,380 | B1 | | 4/2002 | Whelan |
| 6,386,696 | B1 | * | 5/2002 | Rodi et al. ..... 347/103 |
| 6,393,980 | B2 | | 5/2002 | Simons |
| 6,402,317 | B2 | | 6/2002 | Yanagawa et al. |
| 6,416,175 | B2 | | 7/2002 | Furukawa et al. |
| 6,422,696 | B1 | * | 7/2002 | Takahashi et al. ..... 347/103 |
| 6,439,713 | B1 | * | 8/2002 | Noguchi et al. ..... 347/103 |
| 6,470,799 | B2 | | 10/2002 | Nakazawa et al. |
| 6,477,948 | B1 | | 11/2002 | Nissing et al. |
| 6,520,087 | B2 | | 2/2003 | Heinzl et al. |
| 6,526,886 | B2 | | 3/2003 | Loccufier et al. |
| 6,536,873 | B1 | | 3/2003 | Lee et al. |
| 6,539,856 | B2 | | 4/2003 | Jones et al. |
| 6,543,360 | B2 | | 4/2003 | Sasaki et al. |
| 6,558,458 | B1 | | 5/2003 | Gloster |
| 6,566,039 | B1 | * | 5/2003 | Teng ..... 430/302 |
| 6,585,367 | B2 | | 7/2003 | Gore |
| 6,595,631 | B2 | | 7/2003 | Tanikawa et al. |
| 6,634,295 | B1 | | 10/2003 | Newington et al. |
| 6,644,183 | B2 | | 11/2003 | Takasawa et al. |
| 6,648,468 | B2 | * | 11/2003 | Shinkoda et al. ..... 347/103 |
| 6,652,631 | B2 | | 11/2003 | Itakura |
| 6,662,723 | B2 | | 12/2003 | Loccufier et al. |
| 6,679,170 | B2 | | 1/2004 | Mori |
| 6,699,640 | B2 | | 3/2004 | Veruschueren et al. |
| 6,736,500 | B2 | | 5/2004 | Takahashi et al. |
| 6,739,260 | B2 | | 5/2004 | Damme et al. |
| 6,745,693 | B2 | | 6/2004 | Teng |
| 6,758,140 | B1 | | 7/2004 | Szumia et al. |
| 6,772,687 | B2 | | 8/2004 | Damme et al. |
| 6,779,444 | B2 | | 8/2004 | Hauptmann et al. |
| 6,780,305 | B2 | | 8/2004 | Nishino et al. |
| 6,783,228 | B2 | | 8/2004 | Szumia et al. |
| 6,815,075 | B2 | | 11/2004 | Kasai et al. |
| 6,823,789 | B2 | | 11/2004 | Hara et al. |
| 6,851,363 | B2 | | 2/2005 | Schneider |
| 6,851,366 | B2 | | 2/2005 | Gutfleisch et al. |
| 6,852,363 | B2 | | 2/2005 | Loccufier et al. |
| 6,862,992 | B2 | * | 3/2005 | Nakazawa et al. ..... 101/466 |
| 6,906,019 | B2 | | 6/2005 | Nitzan et al. |
| 6,918,663 | B2 | | 7/2005 | Schaschek et al. |
| 6,935,735 | B2 | | 8/2005 | Tanikawa et al. |
| 6,983,693 | B2 | | 1/2006 | Simons |
| 7,070,269 | B2 | | 7/2006 | Tanikawa et al. |
| 7,191,703 | B2 | | 3/2007 | Dilling |
| 7,191,705 | B2 | | 3/2007 | Berg et al. |
| 7,240,998 | B2 | | 7/2007 | Murakami et al. |
| 7,281,790 | B2 | | 10/2007 | Mouri et al. |
| 7,311,396 | B2 | | 12/2007 | Kwon et al. |
| 7,523,704 | B2 | | 4/2009 | Domotor |
| 7,691,280 | B2 | | 4/2010 | Waldrop et al. |
| 7,959,278 | B2 | | 6/2011 | Regan et al. |
| 2001/0020964 | A1 | | 9/2001 | Irihara et al. |
| 2001/0022596 | A1 | | 9/2001 | Korol |
| 2001/0040615 | A1 | * | 11/2001 | Beauchamp et al. ..... 347/103 |
| 2001/0042460 | A1 | | 11/2001 | Yoshida |
| 2002/0001004 | A1 | | 1/2002 | Mantell et al. |
| 2002/0014169 | A1 | | 2/2002 | Siler et al. |
| 2002/0017209 | A1 | | 2/2002 | Gutfleisch et al. |
| 2002/0038611 | A1 | * | 4/2002 | Naniwa et al. ..... 101/465 |
| 2002/0043171 | A1 | | 4/2002 | Loccufier et al. |

(56) References Cited

U.S. PATENT DOCUMENTS

| | | | | |
|---|---|---|---|---|
| 2002/0056388 | A1 | 5/2002 | Makino | |
| 2002/0100383 | A1 | 8/2002 | McPherson et al. | |
| 2002/0104455 | A1* | 8/2002 | Deutsch et al. | 101/463.1 |
| 2002/0139268 | A1 | 10/2002 | Emery et al. | |
| 2002/0154188 | A1 | 10/2002 | Hiyane et al. | |
| 2003/0089261 | A1 | 5/2003 | Landsman | |
| 2003/0103093 | A1 | 6/2003 | Vanhooydonck | |
| 2003/0128249 | A1 | 7/2003 | Booth | |
| 2003/0128250 | A1 | 7/2003 | Booth | |
| 2003/0153649 | A1 | 8/2003 | Bromberg | |
| 2003/0159607 | A1 | 8/2003 | Nitzan et al. | |
| 2003/0210298 | A1 | 11/2003 | Madeley | |
| 2003/0210314 | A1 | 11/2003 | Palmer et al. | |
| 2003/0226463 | A1* | 12/2003 | Teng | 101/463.1 |
| 2004/0053011 | A1 | 3/2004 | Behm et al. | |
| 2004/0085395 | A1 | 5/2004 | Madeley | |
| 2004/0089179 | A1 | 5/2004 | Link | |
| 2004/0090508 | A1* | 5/2004 | Chowdry et al. | 347/103 |
| 2004/0090516 | A1 | 5/2004 | Gruetzmacher et al. | |
| 2004/0103801 | A1 | 6/2004 | Miller et al. | |
| 2004/0103803 | A1* | 6/2004 | Price et al. | 101/350.5 |
| 2004/0106696 | A1 | 6/2004 | Ma et al. | |
| 2004/0109055 | A1* | 6/2004 | Pan et al. | 347/103 |
| 2004/0129158 | A1* | 7/2004 | Figov et al. | 101/401.1 |
| 2004/0135276 | A1 | 7/2004 | Nielsen et al. | |
| 2004/0154489 | A1 | 8/2004 | Deutsch et al. | |
| 2004/0177784 | A1 | 9/2004 | Yamamoto et al. | |
| 2004/0182270 | A1 | 9/2004 | Wiedemer et al. | |
| 2004/0187720 | A1 | 9/2004 | Naniwa et al. | |
| 2004/0250836 | A1* | 12/2004 | Koppelkamm et al. | 134/6 |
| 2005/0028696 | A1* | 2/2005 | Price et al. | 101/335 |
| 2005/0056169 | A1* | 3/2005 | Hashimoto et al. | 101/119 |
| 2005/0110856 | A1* | 5/2005 | Mouri et al. | 347/103 |
| 2005/0115429 | A1 | 6/2005 | Link | |
| 2005/0122355 | A1 | 6/2005 | Kanda et al. | |
| 2005/0181187 | A1 | 8/2005 | Vosseler et al. | |
| 2005/0204945 | A1* | 9/2005 | Sonokawa | 101/463.1 |
| 2005/0211130 | A1 | 9/2005 | Watanabe | |
| 2005/0223927 | A1 | 10/2005 | Wiedemer | |
| 2005/0270351 | A1 | 12/2005 | Mouri et al. | |
| 2006/0011817 | A1 | 1/2006 | Harush et al. | |
| 2006/0040210 | A1 | 2/2006 | Eck et al. | |
| 2006/0066704 | A1* | 3/2006 | Nishida | 347/103 |
| 2006/0075916 | A1 | 4/2006 | Edwards et al. | |
| 2006/0075917 | A1 | 4/2006 | Edwards | |
| 2006/0077243 | A1 | 4/2006 | Edwards | |
| 2006/0077244 | A1 | 4/2006 | Edwards | |
| 2006/0132566 | A1 | 6/2006 | Desie et al. | |
| 2006/0201361 | A1 | 9/2006 | Wiedemer | |
| 2006/0284951 | A1 | 12/2006 | Ikeda et al. | |
| 2007/0062389 | A1 | 3/2007 | Link | |
| 2007/0068404 | A1 | 3/2007 | Hirahara et al. | |
| 2007/0137509 | A1 | 6/2007 | Fork | |
| 2007/0164559 | A1 | 7/2007 | Kozdras | |
| 2007/0199457 | A1 | 8/2007 | Cyman et al. | |
| 2007/0199458 | A1 | 8/2007 | Cyman et al. | |
| 2007/0199459 | A1 | 8/2007 | Cyman et al. | |
| 2007/0199460 | A1 | 8/2007 | Cyman et al. | |
| 2007/0199461 | A1 | 8/2007 | Cyman et al. | |
| 2007/0199469 | A1 | 8/2007 | Zahn | |
| 2007/0200794 | A1* | 8/2007 | Mueller et al. | 345/55 |
| 2007/0204755 | A1* | 9/2007 | Moreau | 101/41 |
| 2007/0227383 | A1 | 10/2007 | Decre et al. | |
| 2007/0240593 | A1 | 10/2007 | Schneider et al. | |
| 2008/0271627 | A1 | 11/2008 | Teng | |
| 2009/0056577 | A1 | 3/2009 | Hook et al. | |
| 2009/0056578 | A1 | 3/2009 | DeJoseph et al. | |
| 2009/0064884 | A1 | 3/2009 | Hook et al. | |
| 2009/0064886 | A1 | 3/2009 | Hook et al. | |
| 2009/0213201 | A1 | 8/2009 | Numata et al. | |

FOREIGN PATENT DOCUMENTS

| | | | |
|---|---|---|---|
| DE | 4327212 | A1 | 2/1995 |
| DE | 10245066 | | 4/2003 |
| EP | 0101266 | | 2/1984 |
| EP | 0126479 | | 11/1984 |
| EP | 0588399 | | 3/1994 |
| EP | 0590164 | | 4/1994 |
| EP | 0601531 | | 6/1994 |
| EP | 0646458 | | 4/1995 |
| EP | 0965444 | | 6/1998 |
| EP | 0882584 | | 12/1998 |
| EP | 0883026 | | 12/1998 |
| EP | 0911154 | | 4/1999 |
| EP | 0911155 | | 4/1999 |
| EP | 0936064 | | 8/1999 |
| EP | 1 118 470 | | 7/2001 |
| EP | 1 118 471 | | 7/2001 |
| EP | 1 118 472 | | 7/2001 |
| EP | 1170122 | | 1/2002 |
| EP | 1177514 | | 2/2002 |
| EP | 1177914 | | 2/2002 |
| EP | 1 426 193 | | 6/2004 |
| EP | 1 522 404 | | 4/2005 |
| EP | 1 547 793 | | 6/2005 |
| JP | 53-15905 | | 2/1978 |
| JP | 56-105960 | | 8/1981 |
| JP | 56-113456 | | 9/1981 |
| JP | 58-217567 | | 12/1983 |
| JP | 62-025081 | | 2/1987 |
| JP | 63-109052 | | 5/1988 |
| JP | 63-125534 | | 8/1988 |
| JP | 02-098482 | | 4/1990 |
| JP | 2-98482 | | 4/1990 |
| JP | 02-269094 | | 11/1990 |
| JP | 4-69244 | | 3/1992 |
| JP | 4-97236 | | 3/1992 |
| JP | 4-97848 | | 3/1992 |
| JP | 06-206297 | | 7/1994 |
| JP | 6-225081 | | 8/1994 |
| JP | 6-270380 | | 9/1994 |
| JP | 8-310101 | | 11/1996 |
| JP | 08-310151 | | 11/1996 |
| JP | 9-85929 | | 3/1997 |
| JP | 09-267549 | | 10/1997 |
| JP | 10-235989 | | 9/1998 |
| JP | 10-286939 | | 10/1998 |
| JP | 2946201 | | 10/1998 |
| JP | 11-028862 | | 2/1999 |
| JP | 11-302585 | | 11/1999 |
| JP | 11-320865 | | 11/1999 |
| JP | 2002-536462 | | 8/2000 |
| JP | 2000-272261 | | 10/2000 |
| JP | 2001-212956 | | 8/2001 |
| JP | 2001-225437 | | 8/2001 |
| JP | 2002-127354 | | 5/2002 |
| JP | 2002-326455 | | 11/2002 |
| JP | 2002 361833 | | 12/2002 |
| JP | 2003-25554 | | 1/2003 |
| JP | 2003-080664 | | 3/2003 |
| JP | 2003-80816 | | 3/2003 |
| JP | 2003-237220 | | 8/2003 |
| JP | 2004-050575 | | 2/2004 |
| JP | 2004-66816 | | 3/2004 |
| JP | 2004-98682 | | 4/2004 |
| JP | 2004-181955 | | 7/2004 |
| JP | 2004-299167 | | 10/2004 |
| JP | 2005-059458 | | 3/2005 |
| JP | 2005-074693 | | 3/2005 |
| JP | 3756943 | | 3/2005 |
| JP | 2005-313490 | | 11/2005 |
| WO | WO 94/11191 | | 5/1994 |
| WO | WO 99/17938 | | 4/1999 |
| WO | WO 01/34394 | | 5/2001 |
| WO | WO 01/49506 | | 7/2001 |
| WO | WO 01/54915 | | 8/2001 |

(56) References Cited

FOREIGN PATENT DOCUMENTS

| | | |
|---|---|---|
| WO | WO 2004/039586 | 5/2004 |
| WO | WO 2007/071551 | 6/2007 |

OTHER PUBLICATIONS

International Preliminary Report on Patentability dated Sep. 4, 2008, International Application No. PCT/US2007/004441 International filing date Feb. 21, 2007.
International Preliminary Report on Patentability dated Sep. 4, 2008, International Application No. PCT/US2007/004440 International filing date Feb. 21, 2007.
International Preliminary Report on Patentability dated Sep. 4, 2008, International Application No. PCT/US2007/004438 International filing date Feb. 21, 2007.
International Preliminary Report on Patentability dated Sep. 4, 2008, International Application No. PCT/US2007/004444 International filing date Feb. 21, 2007.
International Preliminary Report on Patentability dated Sep. 4, 2008, International Application No. PCT/US2007/004442 International filing date Feb. 21, 2007.
International Search Report and Written Opinion in PCT/US2008/009910 dated Jan. 20, 2009.
Search Report in EP 08 00 6593 dated Jan. 12, 2009.
Search Report in EP 08 00 6594 dated Jan. 12, 2009.
Gloster et al., Abstract of "Direct Computer to Plate Printing," *Society for Imaging Science and Technology,* Oct. 2001, 1 page.
Nobuhiro et al., Abstract of "Application of Solid Ink Jet Technology to a Direct Plate Maker," *Science Links Japan,* 1999, 1 page.
Katherine O'Brien, "CTP in Small Packages," *American Printer,* Sep. 1, 1998, 4 pages.
H. Kipphan: "Handbook of Print Media" 2001, Springer, Berlin, XP002446641, p. 52-55.
International Search Report and Written Opinion, International Application No. PCT/US2007/004437 dated Sep. 3, 2007.
International Search Report and Written Opinion, International Application No. PCT/US2007/004441 dated Aug. 28, 2007.
International Search Report and Written Opinion, International Application No. PCT/US2007/004440 dated Aug. 28, 2007.
International Search Report and Written Opinion, International Application No. PCT/US2007/004438 dated Aug. 28, 2007.
International Search Report and Written Opinion, International Application No. PCT/US2007/004444 dated Aug. 28, 2007.
International Search Report and Written Opinion, International Application No. PCT/US2007/004442 dated Aug. 28, 2007.
Letter dated Nov. 2, 2011 to Arochi, Marroquin & Lindner, S.C.
Letter dated Nov. 9, 2011 from Arochi, Marroquin & Lindner, S.C.
Int'l. Search Report and Written Opinion dated Dec. 2, 2011 for International Application No. PCT/US2011/051975.
Second Office Action dated Apr. 6, 2011, with English translation attached, Chinese Patent Application No. 200780006171.3, Applicant Moore Wallace North America, Inc.
Letter to Mr. Qi Xue dated May 12, 2011, with claim amendments attached, Chinese Patent Application No. 200780006171.3, Applicant Moore Wallace North America, Inc.
Letter from Mr. Qi Xue dated Jun. 8, 2011, Chinese Patent Application No. 200780006171.3, Applicant Moore Wallace North America, Inc.
English translation of Office Action dated Aug. 30, 2011, Mexican Patent Application File No. MX/a/2010/001992, Applicant Moore Wallace North America, Inc.
U.S. Appl. No. 61/278,915, Inventors DeJoseph, et al., filed Oct. 14, 2009.
U.S. Appl. No. 61/254,101, Inventors DeJoseph, et al., filed Oct. 22, 2009.
EPO Office Action dated Oct. 1, 2010, EP Application No. 08-006-593.1, Applicant Moore Wallace North America, Inc.
EPO Office Action dated Jul. 28, 2010, EP Application No. 07-751-214.3, Applicant Moore Wallace North America, Inc.
Letter to EPO dated Aug. 12, 2010 with attachment, EP Application No. 08-006-593.1, Applicant Moore Wallace North America, Inc.
Letter to EPO dated Jul. 19, 2010 with attachment, EP Application No. 08828001.1, Applicant Moore Wallace North America, Inc.
EPO Office Action dated Jul. 28, 2010, EP Application No. 08-006-593.1, Applicant Moore Wallace North America, Inc.
International Preliminary Report on Patentability and Written Opinion for PCT/US2008/009911 dated Mar. 4, 2010.
International Preliminary Report on Patentability and Written Opinion for PCT/US2008/009893, dated Mar. 4, 2010.
Response letter to EPO for Appl. No. 08-006-593.1-1251, dated Feb. 8, 2010, and attached amendments.
Lamont Wood, 3-D Home Printers Could Change Economy Oct. 11, 2007, URL: http://www/msnbc.msn.com/id/21252137/, (2 pages).
W. Shen et al., "A New Understanding on the Mechanism of Fountain Solution in the Prevention of Ink Transfer to the Non-image Area in Conventional Offset Lithography", J. Adhesion Sci. Technol., vol. 18, No. 15-16, pp. 1861-1887, (2004), (27 pages).
Air Products, Surfynol® 400 Series Surfactants, (3 pages).
"Amine Ethoxylates," (Jun. 26, 2008), URL: http://www.huntsman.com/performance_products/Index.cfm?PageID=5723 &PrintPage=1&Showtitle=1, (1 page).
"Effect of Polyether Monoamine Structure on Pigment Dispersant Properties," (Feb. 2, 2009), Paint & Coatings Industry, (Mar. 1, 2006), URL: http://www.accessmylibrary.com/comsite5/bin/aml_landing_tt.pl?purchase_type=ITM & item . . . , (5 pages).
R. Steitz et al., "Experimental Report: Does the Chemical Nature of the Substrate Trigger Net Adsorption of Pluronic F127?", BENSC, (Jan. 15, 2003), (1 page).
BASF,Key Features & Benefits, Joncryl® 50, (2 pages); Joncryl® 52 (2 pages); Joncryl® 60 (2 pages); Joncryl® 61 (2 pages); Joncryl® 678 (3 pages); Joncryl® 682 (3 pages), (Mar. 23, 2007).
Polyethylenimines (General Information), (3 pages).
Nissan Chemical—Colloidal Silica, "Snowtex®", URL: http://www.nissanchem-usa.com/snowtex.php, (Jun. 26, 2008), (8 pages).
BASF Corporation 1999, Table of Contents, (37 pages).
BASF Corporation 2002 Technical Bulletin, "Pluronic® F127 Block Copolymer Surfactant", (1 page).
Huntsman Corporation 2005 Technical Bulletin, "Surfonic® T-2 Surfactant", (2 pages).
Huntsman Corporation 2007 Technical Bulletin, "The Use of Surfonamine® Amines in Ink and Pigment Applications", (5 pages).
"Amendment of the Claims" for PCT/US2008/009893 dated Mar. 20, 2009, (2 pages).
"Amendment of the Claims" for PCT/US2008/009910 dated Mar. 19, 2009, (3 pages).
EPO Office Action for Appl. No. 077-751-211.9-1251, dated Sep. 22, 2009, and attached Jul. 1, 2009 letter to EPO and amendments.
Response letter to EPO for Appl. No. 077-751-211.9-1251, dated Jan. 29, 2009, and attached amendments.
EPO Office Action for Appl. No. 077-751-214.3-1251, dated Aug. 3, 2009, and attached Jul. 1, 2009 letter to EPO and amendments.
Response letter to EPO for Appl. No. 077-751-214.3-1251, dated Oct. 21, 2009.
EPO Office Action for Appl. No. 077-751-214.3-1251, dated Dec. 10, 2009, and attached Jul. 1, 2009 letter to EPO and amendments.
Response letter to EPO for Appl. No. 077-751-214.3-1251, dated Mar. 31, 2010, and attached amendments.
EPO Office Action for Appl. No. 08-006-593.1-1251, dated Oct. 8, 2009.
International Search Report and Written Opinion for PCT/US2008/009893 dated Jan. 23, 2009.
Response letter to EPO for Appl. No. 08006594.9, dated Nov. 26, 2009, and attached amendments and EP search report 08006594 Jan. 12, 2009.
International Preliminary Report on Patentability and Written Opinion for PCT/US2008/009910 dated Mar. 4, 2010.
International Preliminary Report on Patentability and Written Opinion for PCT/US2008/009901 dated Mar. 4, 2010.
Letter from Mr. Qi Xue regarding Second Office Action from Chinese Patent Office dated Nov. 29, 2010, Chinese Patent Application No. 200780006170.9, Applicant Moore Wallace North America, Inc.

(56) References Cited

OTHER PUBLICATIONS

Second Office Action dated Nov. 3, 2010, with English translation attached, Chinese Patent Application No. 200780006170.9, Applicant Moore Wallace North America, Inc.
Letter to Mr. Qi Xue dated Jan. 4, 2011, Chinese Patent Application No. 200780006170.9, Applicant Moore Wallace North America, Inc.
Letter from Mr. Qi Xue dated Jan. 7, 2011, Chinese Patent Application No. 200780006170.9, Applicant Moore Wallace North America, Inc.
Letter to Mr. Qi Xue dated Jan. 12, 2011 regarding Jan. 7, 2011 communication, Chinese Patent Application No. 200780006170.9, Applicant Moore Wallace North America, Inc.
Letter from Mr. Qi Xue dated Jan. 13, 2011, Chinese Patent Application No. 200780006170.9, Applicant Moore Wallace North America, Inc.
Letter to Mr. Qi Xue dated Jan. 12, 2011 regarding Jan. 12, 2011 communication, Chinese Patent Application No. 200780006170.9, Applicant Moore Wallace North America, Inc.
Letter from Mr. Qi Xue dated Jan. 18, 2011 regarding Second Office Action Response, Chinese Patent Application No. 200780006170.9, Applicant Moore Wallace North America, Inc.
Second Office Action Response dated Jan. 18, 2011, with English translation attached, Chinese Patent Application No. 200780006170.9, Applicant Moore Wallace North America, Inc.
Email to Mr. Qi Xue dated Mar. 9, 2011, with substitute Response to Second Office Action attached, Chinese Patent Application No. 200780006170.9, Applicant Moore Wallace North America, Inc.
www.flickr.com, "MacWorld Magazine: Cover Art Woes", website, http://www.flickr.com/photos/66071596@N00/3964123486/ (printed on Mar. 8, 2011).
www.livedocs.adobe.com, "Fill a selection or layer with a color", website, http://livedocs.adobe.com/en_US/Photoshop/10.0/help.html?content—WSfd1234e1c4b69f30ea53e41001031ab64-77d4.html (printed on Mar. 8, 2011).
www.magazinepublisher.com, "Mailing Magazines", website, http://www.magazinepublisher.com/mailing.html (printed on Mar. 8, 2011).
www.printindustry.com, "Magazine Cover Wraps", website, http://www.printindustry.com/Newsletters/Newsletter—67.aspx (printed on Mar. 8, 2011).
www.mdprint.com, "M&D Printing Periodical Co-mailing Template Inkjet Knockout Version", available at http://www.mdprint.com/knockout%20template.pdf, (printed on Mar. 8, 2011).
www.riponprinters.com, "Designing Your Mailpiece for Inkjet Addressing", available at http://www.riponprinters.com/tech—library/pdf/M7_TLines_Design_for_Inkjet.pdf (printed on Mar. 8, 2011).
www.malanenewman.com, "Graphic Design Terminology", website, available at http://www.malanenewman.com/graphic_design_terminology.html (printed on Mar. 8, 2011).
International Search Report and Written Opinion in PCT/US2010/053830 dated Dec. 27, 2010.
EPO Communication under Rule 71(3) EPC dated Jan. 10, 2011, with attached examiner's amendments, European Patent Appl. No. 07751211.9, Applicant Moore Wallace North America, Inc.
Second email to Mr. Qi Xue dated Mar. 9, 2011, with revised substitute Response to Second Office Action attached, Chinese Patent Application No. 200780006170.9, Applicant Moore Wallace North America, Inc.
Letter to EPO dated Dec. 7, 2010, with attachments, EP Application No. 08-006-593.1, Applicant Moore Wallace North America, Inc.
Letter to EPO dated Nov. 30, 2010, with attachments, EP Application No. 07-751-214.3, Applicant Moore Wallace North America, Inc.
European Patent Office Search Report & Written Opinion, EP 11 17 1598 dated Sep. 14, 2011
Response, dated Apr. 11, 2012, to European Patent Office Search Report and Written Opinion, dated Sep. 9, 2011, (3 pages), European Patent Application No. 11171598.3, Applicant Moore Wallace North America Inc.
Office Action dated Dec. 27, 2011, for JP Patent Application No. 2008-556392, with English translation attached, Applicant, Moore Wallace North America, Inc., (5 pages).
EP Search Report and English translation, dated Jan. 5, 2012, for European Patent Application No. EP 11 18 4552, Applicant, Moore Wallace North America, Inc., (7 pages).
Office Action dated Jan. 24, 2012, for JP Patent Application No. 2008-556396, with English translation attached, Applicant, Moore Wallace North America, Inc., (7 pages).
Second Office Action dated Feb. 16, 2012, for CN Patent Application No. 2008-80113100.8, Applicant, Moore Wallace North America, Inc., (6 pages).
European Patent Office Response dated Dec. 4, 2012 for European Patent Application 11171598.3, Applicant, Moore Wallace North America Inc. (4 pages).
European Patent Office Response dated Dec. 18, 2012 for European Patent Application 11171598.3, Applicant, Moore Wallace North America Inc. (2 pages).
Japanese Patent Office Action dated Oct. 23, 2012 for Japanese Patent Application 2010-521872, with English translation attached, Applicant, Moore Wallace North America Inc. (6 pages).
Japanese Patent Office Action dated Oct. 2, 2012, for Japanese Patent Application 2010-521871, with English translation attached, Applicant, Moore Wallace North America Inc. (9 pages).
English translation of Japanese Patent Application JP 4-97848, Applicant, Mitsubishi Heavy Industries KK. (9 pages).
Amendment/Instructions to Japanese associate dated Jan. 9, 2013 and confirmation of Amendment filing dated Jan. 23, 2013 (9 pages).
English Translation of Office Action for Korean Application No. 10-2008-7022776 dated Apr. 26, 2013 (2 pages).
Letter to YOU ME Patent & Law Firm dated May 31, 2013 regarding proposed response to Office action for Korean Application No. 10-2008-7022776 (2 pages).
E-mail to YOU ME Patent & Law Firm dated Jun. 21, 2013 regarding proposed Response for Korean Application No. 10-2008-7022776 (2 pages).
Letter from YOU ME Patent & Law Firm dated Jun. 27, 2013 confirming filing of the Response to the Office action dated Apr. 26, 2013 for Korean Application No. 10-2008-7022776 (1 page).
Office Action Response and English translation of Claim amendments filed Jun. 24, 2013 for Korean Application No. 10-2008-7022776 (11 pages).
English Translation of Office Action for Japanese Application No. 2013-019356 dated Jan. 27, 2015 (3 pages).
Office Action for Japanese Patent Application No. 2013-019356 dated Jan. 27, 2015 (3 pages).

* cited by examiner

SYSTEMS AND METHODS FOR HIGH SPEED VARIABLE PRINTING

CROSS-REFERENCE TO RELATED APPLICATIONS

This application claims the benefit of U.S. Provisional Patent Application Nos. 60/775,511, filed Feb. 21, 2006 and 60/819,301, filed Jul. 7, 2006, both of which are hereby incorporated by reference herein in their entireties.

BACKGROUND OF THE INVENTION

Lithographic and gravure printing techniques have been refined and improved for many years. The basic principle of lithography is transferring ink from a surface having both ink-receptive and ink-repellent areas. Offset printing incorporates an intermediate transfer of the ink. For example, an offset lithographic press may transfer ink from a plate cylinder to a rubber blanket cylinder, and then the blanket cylinder transfers the image to the web (i.e., paper). In gravure printing, a cylinder with engraved ink wells makes contact with a web of paper and an electric charge helps transfer the ink onto the paper.

Early implementations of lithographic technology utilized reliefs of the image to be printed on the plate such that ink would only be received by the raised areas. Modern lithographic processes take advantage of materials science principles. For example, the image to be printed may be etched onto a hydrophilic plate such that the plate is hydrophobic in the areas to be printed. The plate is wetted before inking such that oil-based ink is only received by the hydrophobic regions of the plate (i.e., the regions of the plate that were not wetted by the dampening process).

However, all of these printing techniques have a similar limitation. The same image is printed over and over again. Lithographic printing uses plates containing a permanent image, whether it be a relief image or an etched hydrophobic image, etc. Gravure printing also uses a permanent image which is engraved in ink wells on a cylinder. Therefore, lithographic and gravure presses have not been used for printing "short-run" jobs or jobs containing variable data (e.g., billing statements, financial statements, targeted advertisements, etc.). There is a substantial overhead cost involved in making the plates that are used by a lithographic press. Therefore, it is not cost effective to print a job on a lithographic press that will have few copies produced (i.e., a short-run job). Furthermore, the content cannot be varied, such as in laser printing and ink jet printing.

Traditionally, many printed articles such as books and magazines have been printed using a process that involves a great deal of post-press processing. For example, a single page of the magazine may be printed 5,000 times. Then, a second page may be printed 5,000 times. This process is repeated for each page of the magazine until all pages have been printed. Then, the pages are sent to post-processing for cutting and assembly into the final articles. If variable images could be printed at lithographic image quality and speed, each magazine could be printed in sequential page order such that completed magazines would come directly off the press. This would drastically increase the speed and reduce the expenses of printing a magazine.

Ink jet printing technology provided printers with variable capability. There are two main ink jet technologies: bubble jet (i.e., thermal) and piezoelectric. In each, tiny droplets of ink are fired onto a page. In a bubble jet printer, a heat source vaporizes ink to create a bubble. The expanding bubble causes a droplet to form, and the droplet is ejected from the print head. Piezoelectric technology uses a piezo crystal located at the back of each ink reservoir. Electric charges are used to cause vibrations in the crystals. The back and forth motion of the crystal is able to draw in enough ink for one droplet and eject that ink onto the paper.

The quality of color ink jet printing is generally orders of magnitude lower than that of offset lithography and gravure. Furthermore, the speed of the fastest ink jet printer is typically much slower than a lithographic or gravure press. Traditional ink jet printing is also plagued by the effect of placing a water-based ink on paper. Using a water-based ink may saturate the paper and may lead to wrinkling and cockling of the print web. In order to control these phenomena, ink jet printers use certain specialized papers or coatings. These papers can often be much more expensive than a traditional web.

Furthermore, when ink jet technology is used for color printing, the ink coverage and water saturation is increased. This is due to the four color process that is used to generate color images. Four color processing involves laying cyan, magenta, yellow and black (i.e., CMYK) ink in varying amounts to make any color on the page. Thus, some portions of the page may have as many as four layers of ink if all four colors are necessary to produce the desired color. Additionally, the dots produced by an ink jet printer may spread and produce a fuzzy image.

Laser printing does not appear to be a viable alternative for high speed variable printing at present, because production speeds are still much slower than offset and gravure, and the material costs (e.g., toner, etc.) are extremely high. Laser color is also difficult to use for magazines and other bound publications, because the printed pages often crack when they are folded.

Therefore, it would be desirable to develop a variable printing technique having the quality and speed of traditional lithographic and gravure printing. It would further be desirable to provide a variable printing system that operated at speeds of at least 400 feet per minute.

SUMMARY OF THE INVENTION

In accordance with the principles of the present invention, apparatus and methods for high speed variable printing are provided. An objective of the present invention is to achieve variable lithographic quality printing. The method may combine ink jet technology and lithographic systems to create a fully variable, high quality, high speed print system. In one embodiment, the typical dampening system used in a traditional offset lithographic deck may be removed and replaced with a cleaning system and an aqueous jet system. The aqueous jet system may be used to print a negative image variably onto a lithographic plate cylinder. The aqueous solution may include water, ethylene glycol, propylene glycol, any other suitable glycol, or any combination thereof. For example, in some embodiments, the aqueous solution may be a combination of water and ethylene glycol, water alone, or any other suitable solution. Due to the hydrophilic properties of the plate, the aqueous solution will stay in place. These wetted areas will not accept oil-based ink when the plate passes through an inking system. The cleaning system may remove residue ink and/or aqueous solution after each revolution of the plate cylinder or after a certain number or revolutions.

In some embodiments of the present invention, the typical dampening system of a traditional offset lithographic deck is replaced with an aqueous jet system with at least one ink jet head that emits an aqueous solution instead of ink. In such embodiments, ink jet and lithographic technologies may be merged. The aqueous solution is "printed" or jetted onto the plate cylinder by the ink jet heads at variable locations to produce a negative variable image.

In some embodiments, the blanket cylinder of an offset press may be variably imaged by the aqueous jet system in lieu of, or in addition to, the plate cylinder. The aqueous solution jetted image may vary for each revolution of the plate or blanket cylinder. A cleaning system may be used to remove residue aqueous solution and/or ink for each rotation of the cylinder or for a certain number of revolutions.

In some embodiments, the high speed variable printing apparatus is in communication with a back-end database management system. The database management system may be in communication with one or more image controllers that control the operation of the aqueous jet and lithographic systems to provide a versatile, user-reconfigurable variable printing apparatus.

BRIEF DESCRIPTION OF THE DRAWINGS

Further features of the invention, its nature, and various advantages will be more apparent from the following detailed description and the accompanying drawings, in which.

DETAILED DESCRIPTION

Figure 1:
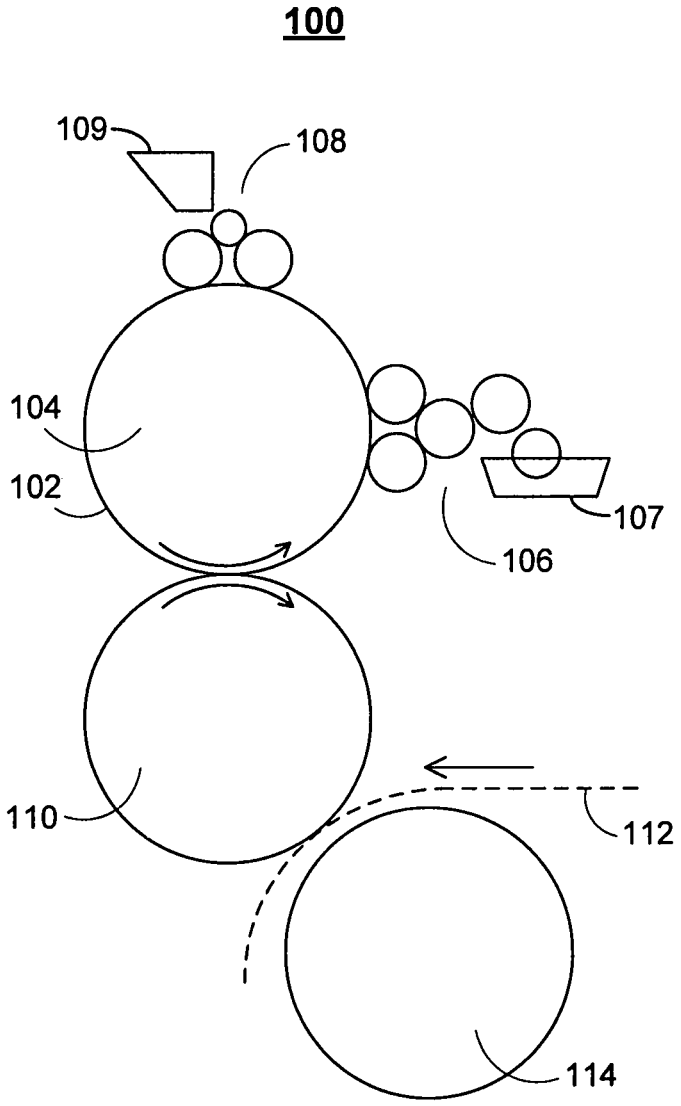
FIG. 1 PRIOR ART
FIG. 1 is a side view of a prior art printing system.

FIG. 1 illustrates traditional offset lithographic printing deck 100. In a traditional lithographic process, the image to be printed is etched onto hydrophilic plate 102 to create hydrophobic regions on the plate which will be receptive to ink. Hydrophilic plate 102 is mounted on plate cylinder 104 and rotated through dampening system 106 and inking system 108. Dampening system 106 may include water supply 107, and inking system 108 may include ink source 109. The hydrophilic portions of plate 102 are wetted by dampening system 106. By using an oil-based ink, ink is only received by the hydrophobic portions of plate 102.

If a blanket cylinder is used, such as blanket cylinder 110, the inked image may be transmitted from plate cylinder 104 to blanket cylinder 110. Then, the image may be further transferred to web 112 (e.g., paper) between blanket cylinder 110 and impression cylinder 114. Using impression cylinder 114, the image transfer to web 112 may be accomplished by applying substantially equal pressure or force between the image to be printed and web 112. When a rubber blanket is used as an intermediary between plate cylinder 104 and web 112, this process is often referred to as "offset printing." Because plate 102 is etched and then mounted on plate cylinder 104, a lithographic press is used to print the same image over and over. Lithographic printing is desirable because of the high quality that it produces. When four printing decks are mounted in series, magazine-quality four color images can be printed.

Figure 2:
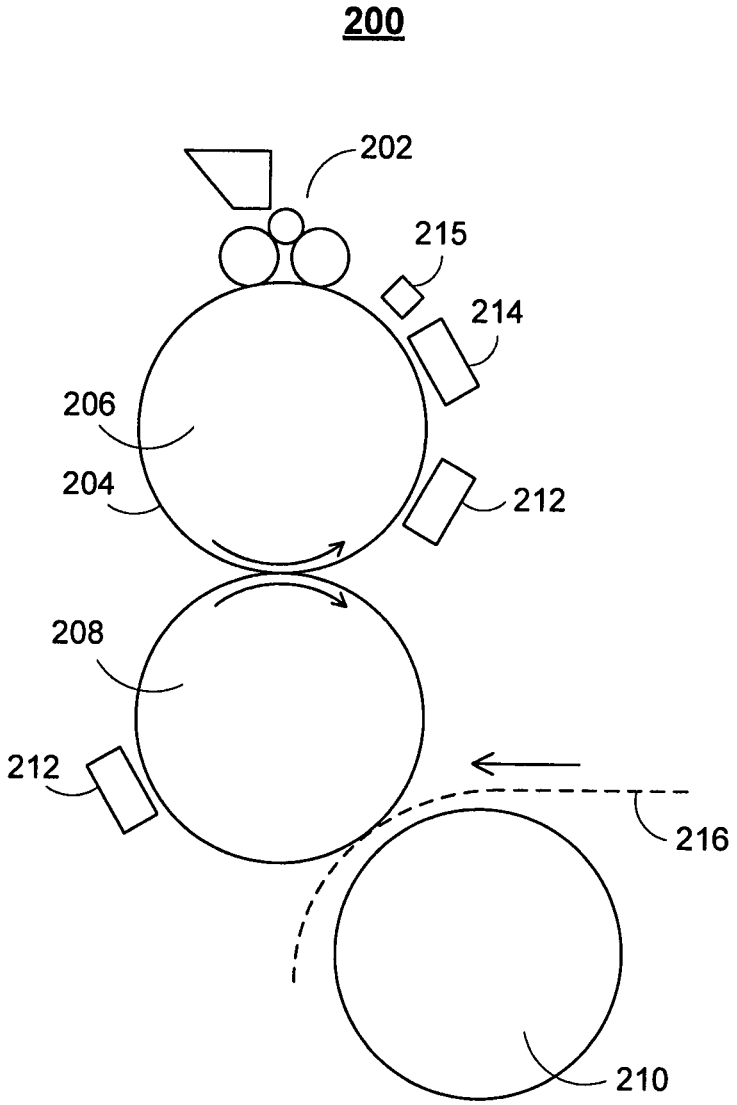
FIG. 2 is a side view of an illustrative embodiment of apparatus in accordance with the principles of the present invention.

Illustrative apparatus in accordance with the principles of the present invention are illustrated in FIG. 2. FIG. 2 illustrates printing deck 200, which may include inking system 202, plate 204, plate cylinder 206, blanket cylinder 208, and impression cylinder 210 as known in the lithographic printing industry. Plate 204 may be entirely hydrophilic (e.g., a standard aluminum lithographic plate). However, dampening system 106 of FIG. 1 has been replaced with cleaning system 212 and aqueous jet system 214 in FIG. 2.

Aqueous jet system 214 may contain a series of ink jet cartridges (e.g., bubble jet cartridges, thermal cartridges, piezoelectric cartridges, etc.). A bubble jet may emit a drop of ink when excited by a heater. A piezoelectric system may eject a drop of ink when excited by a piezoelectric actuator. The drop is emitted from a tiny hole in the ink jet cartridges. The cartridges may contain any number of holes. Commonly, ink jet cartridges can be found with six hundred holes, often arranged in two rows of three hundred.

In the present invention, aqueous jet system 214 may be used to emit an aqueous solution (e.g., water, ethylene glycol, propylene glycol, or any combination thereof). In some embodiments of the present invention, the aqueous solution may contain one or more surfactants, such as Air Products' Surfynol®. Such surfactants may contain a hydrophilic group at one end of each molecule and a lipophilic group at the other end of each molecule. Adding one or more surfactants to the aqueous solution may improve the surface tension properties of the aqueous solution. This may provide more control over drop placement and produce higher quality printed images.

The aqueous jets of aqueous jet system 214 may be used to place aqueous solution on a hydrophilic plate in much the same way that a drop of ink is placed on a piece of paper by an ink jet. In some embodiments, the aqueous solution may be ejected through traditional ink jet nozzles. Such ink jet nozzles may include, for example, ink jet nozzles manufactured by HP, Lexmark, Spectra, Canon, etc. In some embodiments, aqueous jet system 214 may support variable print speeds and output resolutions.

Figure 12:
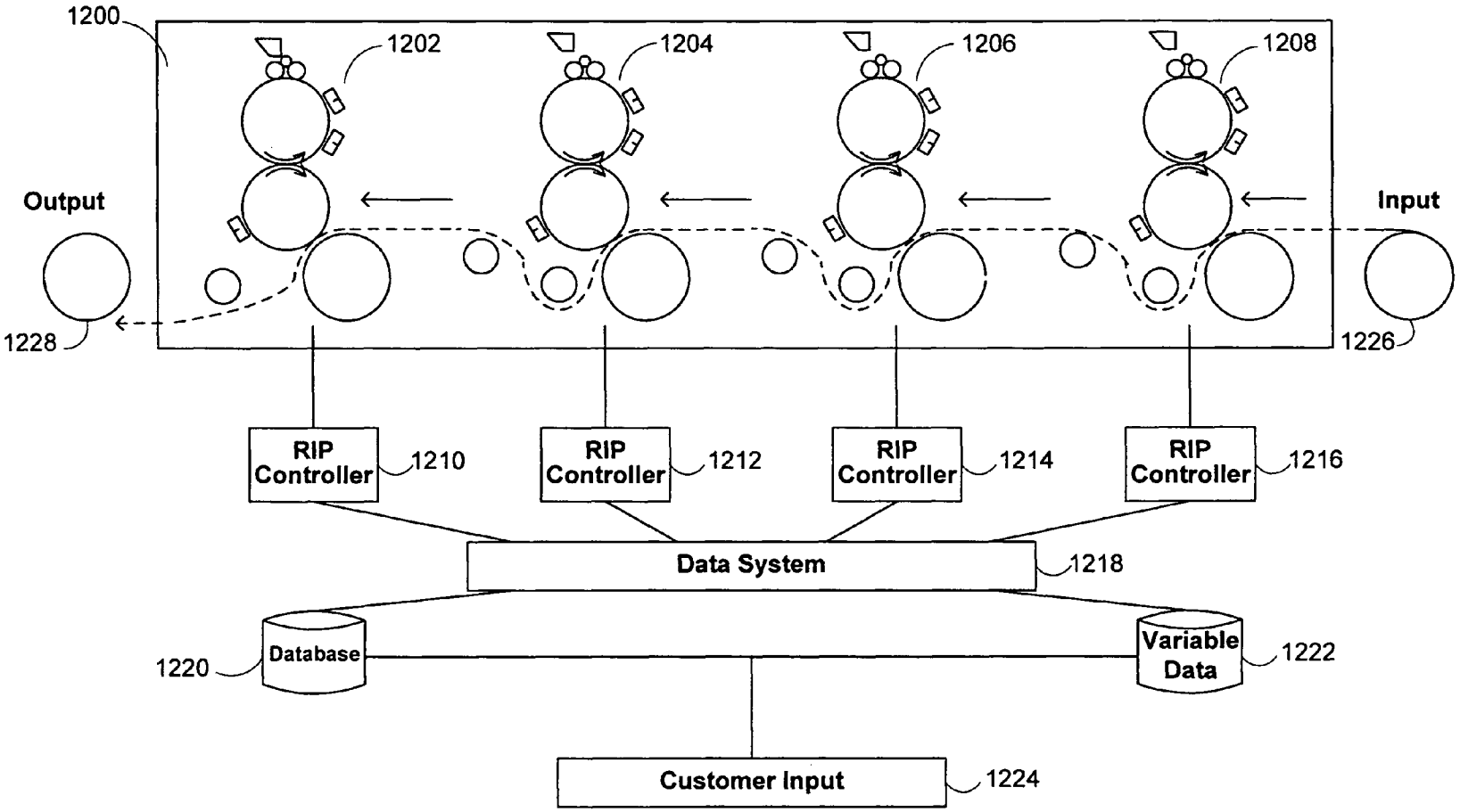
FIG. 12 is a view of an illustrative embodiment of apparatus in accordance with the principles of the present invention.

In accordance with the principles of the present invention, aqueous jet system 214 may be used to "print" or jet a negative image of the image to be printed, or any portion thereof, on plate cylinder 206. For example, as described in more detail below with regard to FIG. 12, an image controller may receive image data from a data system. The image data may represent the image to be printed or the negative image to be printed. The image data may include variable image data that changes relatively frequently (e.g., every printed page), semi-fixed image data that changes less frequently (e.g., every 100 printed pages), fixed image data that remains static, and any combination of variable, semi-fixed, and fixed image data. Some or all of the image data may be stored as binary data, bitmap data, page description code, or a combination of binary data, bitmap data, and page description code. For example, a page description language (PDL), such as PostScript or Printer Command Language (PCL), may be used to define and interpret image data in some embodiments. A data system may then electronically control aqueous jet system 214 to print in aqueous solution the image (or the negative image) represented by some or all of the different types of image data (or any portion thereof) onto plate cylinder 206. The negative image may be an image of every portion of the paper that is not to receive ink. Thus, after a point on plate cylinder 206 passes aqueous jet system 214, that point will only receive ink from inking system 202 if a drop of aqueous solution was not placed at that point.

In some embodiments of the present invention, vacuum source or heat source 215 may be positioned next to or near aqueous jet system 214. In some embodiments, vacuum source or heat source 215 may be integrated with aqueous jet system 214. The vacuum source or heat source may be used to reduce the size of the individual drops of aqueous solution placed by aqueous jet system 214 by blowing, drying, and/or heating the aqueous solution after it is printed onto plate 204 or plate cylinder 206. The ability to control drop size of the aqueous solution may improve the quality of the printed image.

As plate cylinder 206 completes its revolution, after passing the image to blanket cylinder 208, it passes through cleaning system 212, which may remove ink and/or aqueous solution residue so that plate cylinder 206 may be re-imaged by aqueous jet system 214 during the next revolution (or after a certain number of revolutions). Cleaning system 212 may comprise a rotary brush, a roller having a cleaning solution, a belt, a cleaning web treated with a cleaning solution, an apparatus for delivering heat and/or air, an electrostatic apparatus, or any other suitable means of removing ink, aqueous solution residue, or both, from plate cylinder 206. In some embodiments, blanket cylinder 208 may also have a cleaning system similar to cleaning system 215 to clean any residual material from blanket cylinder 208 after the image has been transferred to web 216.

In some embodiments, plate cylinder 206 may have all of the static data for a particular print job etched onto plate 204 by traditional lithographic techniques. Aqueous jet system 214 may then be used to image only variable portions of the job represented by the variable or semi-fixed image data on specified portions of plate 204.

In other embodiments, plate 204 may not be used. Instead, as is understood in the art, the surface of plate cylinder 206 may be treated, processed, or milled to receive the aqueous solution from aqueous jet system 214. Additionally, plate cylinder 206 may be treated, processed, or milled to contain the static data and be receptive to the aqueous solution to incorporate variable data. In these and any other embodiments of the present invention, blanket cylinder 208 may be eliminated entirely, if desired, by transferring the image directly to web 216.

In some embodiments, one or more of plate 204, plate cylinder 206, and blanket cylinder 208 may be customized or designed to work with various properties of aqueous jet system 214 or the aqueous solution. For example, as is understood in the art, one or more of these plates and cylinders may be specially processed or milled to only accept solution ejected by print heads of a particular resolution or dot size. The plates and cylinders may also be specially processed to accept certain types of aqueous solutions and reject others. For example, the plates and cylinders may accept solutions of a certain volume, specific gravity, viscosity, or any other desired property, while rejecting solutions outside the desired parameters. This may prevent, for example, foreign agent contamination and allow for one aqueous solution to be used in the printing process and another aqueous solution (with different physical properties) to be used in the cleaning process. In other embodiments, customary, general-purpose plates and cylinders are used.

Figure 3:
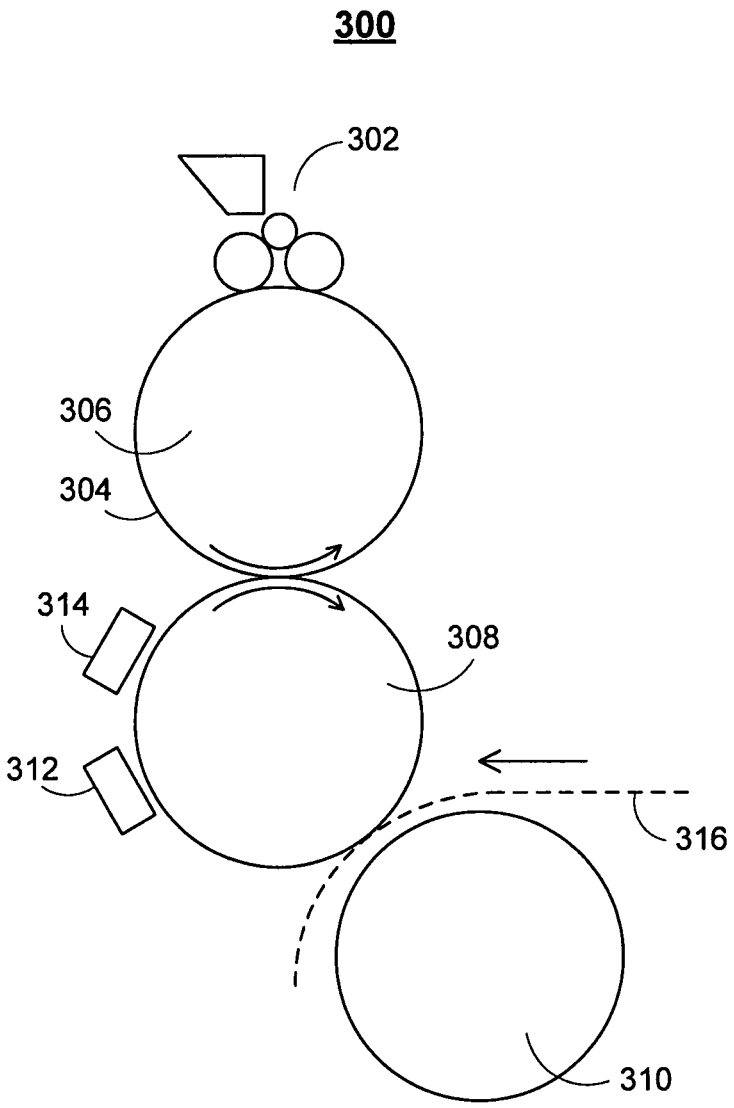
FIG. 3 is a side view of an illustrative embodiment of apparatus in accordance with the principles of the present invention.

As shown in FIG. 3, printing deck 300 may include aqueous jet system 314 and cleaning system 312, one or both of which may be mounted and used on blanket cylinder 308 instead of plate cylinder 306. As described with regard to FIG. 2, printing deck 300 may also include inking system 302 over plate cylinder 306. In this embodiment of the present invention, plate cylinder 306 with plate 304 may be receptive to ink over its entire surface and become completely coated with ink after passing through inking system 302. However, blanket cylinder 308 may be variably imaged with an aqueous solution as described above such that ink is only transferred to certain portions of blanket cylinder 308 for transfer to web 316, which may be between blanket cylinder 308 and impression cylinder 310. When aqueous jet system 314 is used with blanket cylinder 308, as opposed to plate cylinder 306, it may be possible to use a higher volume of aqueous solution, which may result in faster imaging and re-imaging. This is due to the material properties and surface properties of blanket cylinder 308, which may include a rubber blanket that prevents spreading of the aqueous solution drops.

Figure 4:
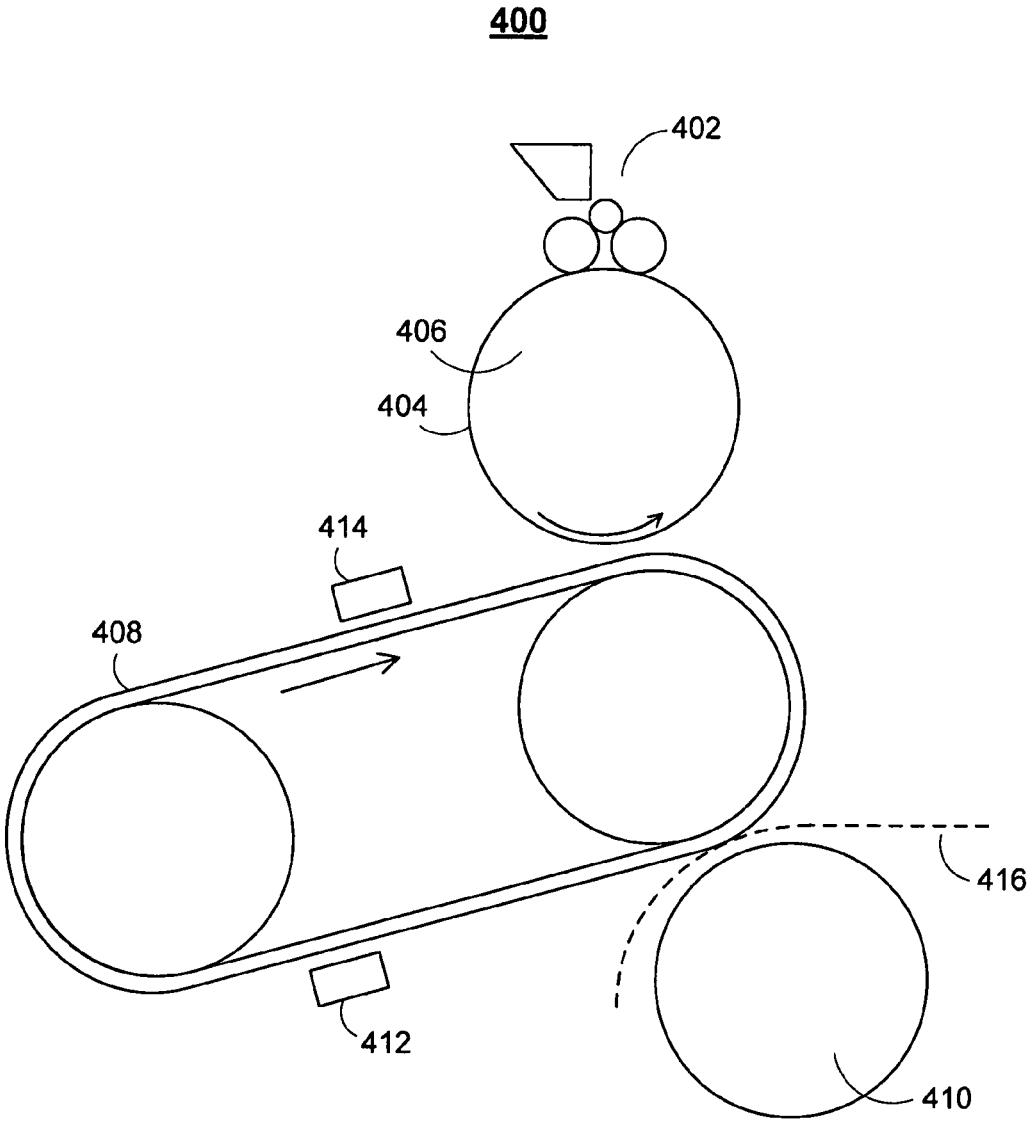
FIG. 4 is a side view of an illustrative embodiment of apparatus in accordance with the principles of the present invention.

The aqueous jet system and cleaning system may be mounted in other arrangements as well. As shown in the example of FIG. 4, printing deck 400 allows for more flexibility in the placement of aqueous jet system 414 and cleaning system 412. In the example of FIG. 4, the blanket cylinder may be replaced with endless belt 408. In some embodiments, the length of endless belt 408 may be adjustable to accommodate various additional systems or more convenient placement of aqueous jet system 414 and cleaning system 412. Aqueous jet system 414 and cleaning system 412 may be mounted at any suitable location along endless belt 408. As described above with regard to FIGS. 2 and 3, printing deck 400 may also include inking system 402, plate cylinder 406, plate 404, and web 416 between endless belt 408 and impression cylinder 410. Endless belt 408 may be variably imaged with an aqueous solution as described above with regard to blanket cylinder 308 of FIG. 3 such that ink is only transferred to certain portions of endless belt 408 for transfer to web 416.

Figure 5:
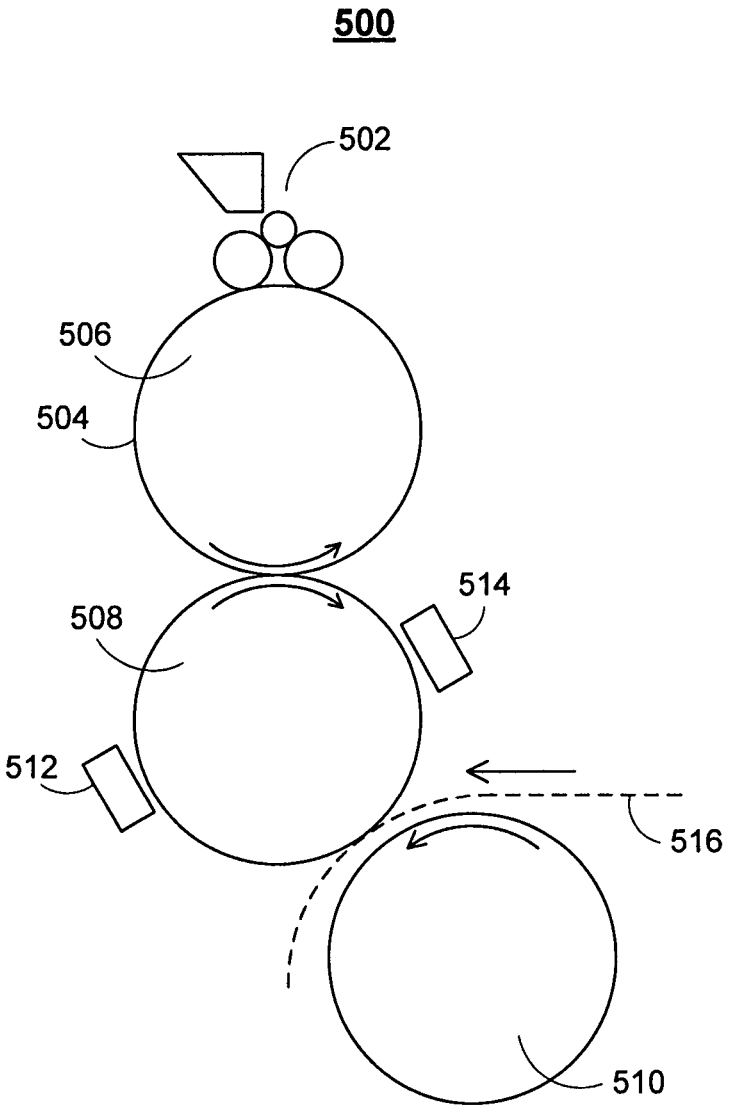
FIG. 5 is a side view of an illustrative embodiment of apparatus in accordance with the principles of the present invention.
Figure 6:
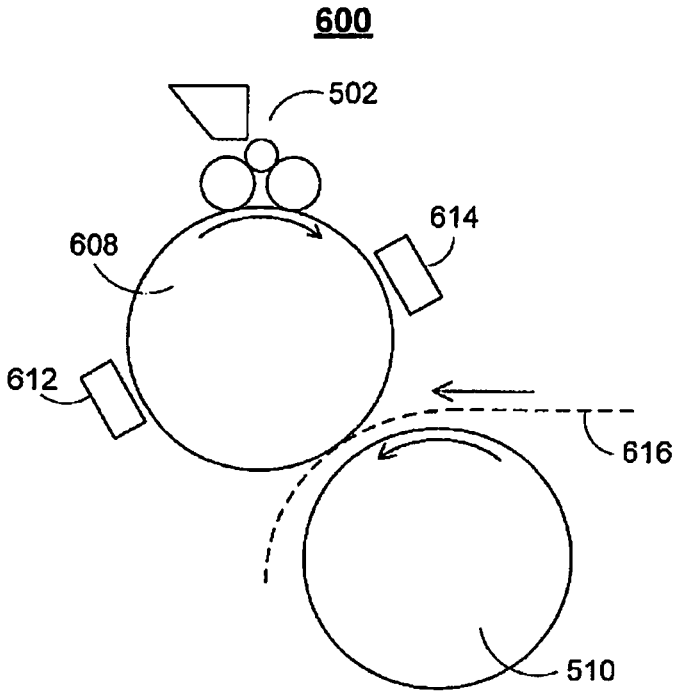
FIG. 6 is a side view of an illustrative embodiment of apparatus in accordance with the principles of the present invention.

FIGS. 5 and 6 depict alternative embodiments of the present invention. As shown in FIG. 5, printing deck 500 may include plate cylinder 506, which may be used to transfer ink to blanket cylinder 508. As described above, printing deck 500 may also include inking system 502, plate 504, blanket cylinder 508, aqueous jet system 514, cleaning system 512, web 516, and impression cylinder 510. As shown in printing deck 600 of FIG. 6, in some embodiments, the plate and blanket cylinder system of FIG. 5 may be replaced with single imaging cylinder 608. In both embodiments of FIGS. 5 and 6, ink may be transferred to the cylinder that will contact the print medium (e.g., web 516 or 616) without regard to the image to be printed. Once ink is transferred to the cylinder, aqueous jet system 514 or 614 may then be used to place aqueous solution on top of the ink layer at the points that should not be transferred to the web. In other words, the negative image of the image to be printed is printed in aqueous solution on top of the ink layer. In some embodiments, a gel (e.g., a silicone-based gel) may be used as an alternative to the aqueous solution.

Figure 7:
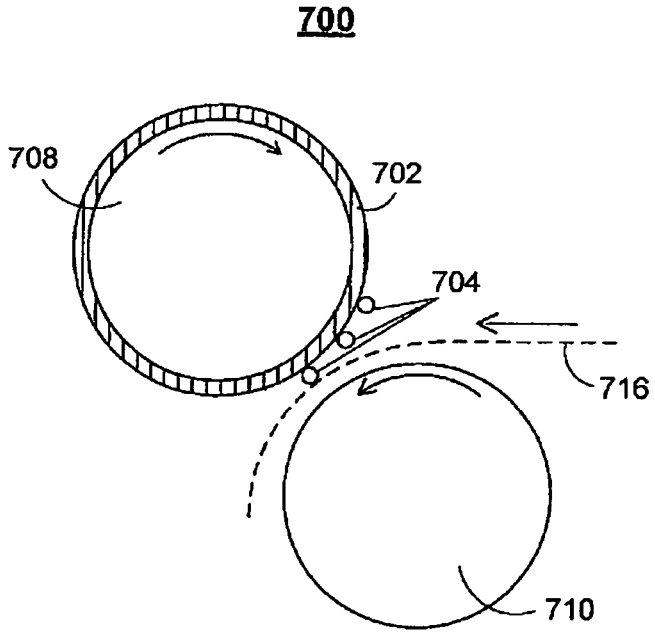
FIG. 7 is an enlarged portion of the side view of an illustrative embodiment of apparatus shown in FIG. 6 in accordance with the principles of the present invention.

As shown in FIG. 7, the aqueous solution or gel drops 704 prohibit ink 702 from transferring to the print medium (e.g., web 716 between imaging cylinder 708 and impression cylinder 710). If the print medium is too absorptive, the print medium may absorb all of the aqueous solution or gel and some ink before the print medium comes away from contact with the imaging cylinder at that point. Thus, if the print medium is too absorptive, the aqueous solution or gel may only act to lighten (or wash out) the image at the points that were covered with the aqueous solution or gel. Oppositely, if a high gloss or plastic print medium is used, the ink may be prohibited from transferring to the print medium, because such print mediums may never absorb the aqueous solution or gel drops 704 that are blocking ink 702. Either way, ink 702 that is not covered with a protective layer of aqueous solution or gel drops 704 is transferred to web 716.

One benefit of an embodiment like that shown in FIGS. 5-7 is that the need for a cleaning system may be eliminated. Because imaging cylinder 708 is constantly being inked over its entire surface with ink 702, there may be no need to clean off the ink at any point in the process. A cleaning system is illustrated in FIGS. 5 and 6, however, because it may be desirable to clean off ink that may be drying or accumulating. In addition, a vacuum source or heat source (such as vacuum source or heat source 215 of FIG. 2) may be used in place of or in addition to the cleaning system. It may be desirable to dry any excess aqueous solution from the imaging cylinder before passing the imaging cylinder through the inking system again. Therefore, the vacuum source or heat source may be used to eliminate any residual aqueous solution before re-inking.

Properties of the aqueous solution or gel (e.g., viscosity or specific gravity) and of the print medium (e.g., using bond paper, gloss paper, or various coating techniques) may be varied to achieve a desirable interaction between the protective negative image that is printed with the aqueous jet system and the print medium. For example, if image sharpness is desired, it may be beneficial to choose an aqueous solution that will not be absorbed at all by the print medium. However, if some transfer of ink is desirable even from the areas covered with the output of the aqueous jet system, it may be beneficial to use a print medium that quickly absorbs the aqueous solution so that some ink transfer is also able to occur from the covered areas.

Figure 8:
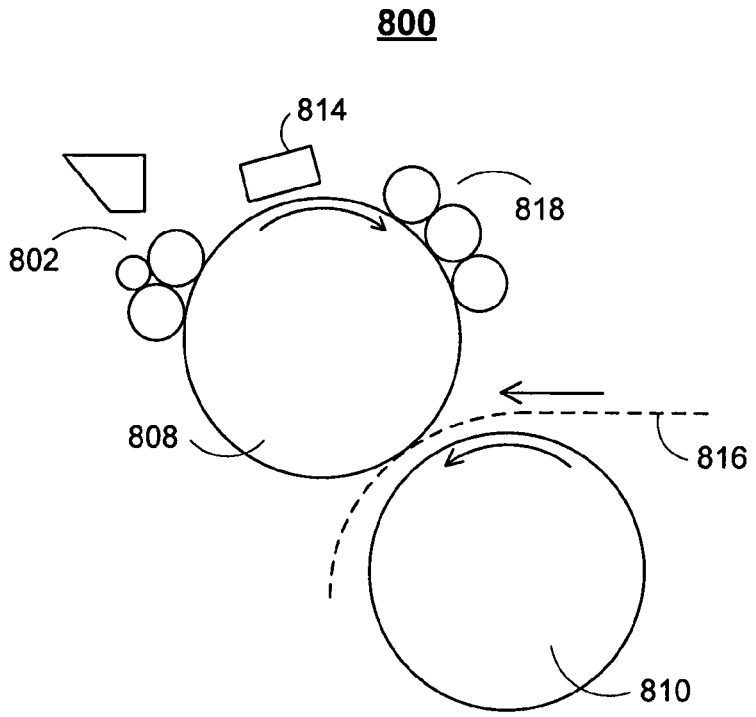
FIGS. 8 and 8A are side views of illustrative embodiments of apparatus in accordance with the principles of the present invention.

FIG. 8 illustrates yet another alternative embodiment of the present invention. Printing deck 800 includes inking system 802, which is used to apply ink to imaging cylinder 808. Then, aqueous jet system 814 is used to print the positive image of the image to be transferred to the print medium (e.g., web 816 between imaging cylinder 808 and impression cylinder 810). Aqueous jet system 814 prints this positive image in aqueous solution or gel on top of the ink layer. This "printed" layer is used to protect the ink in the regions that are to be transferred to the web.

Figure 8A:
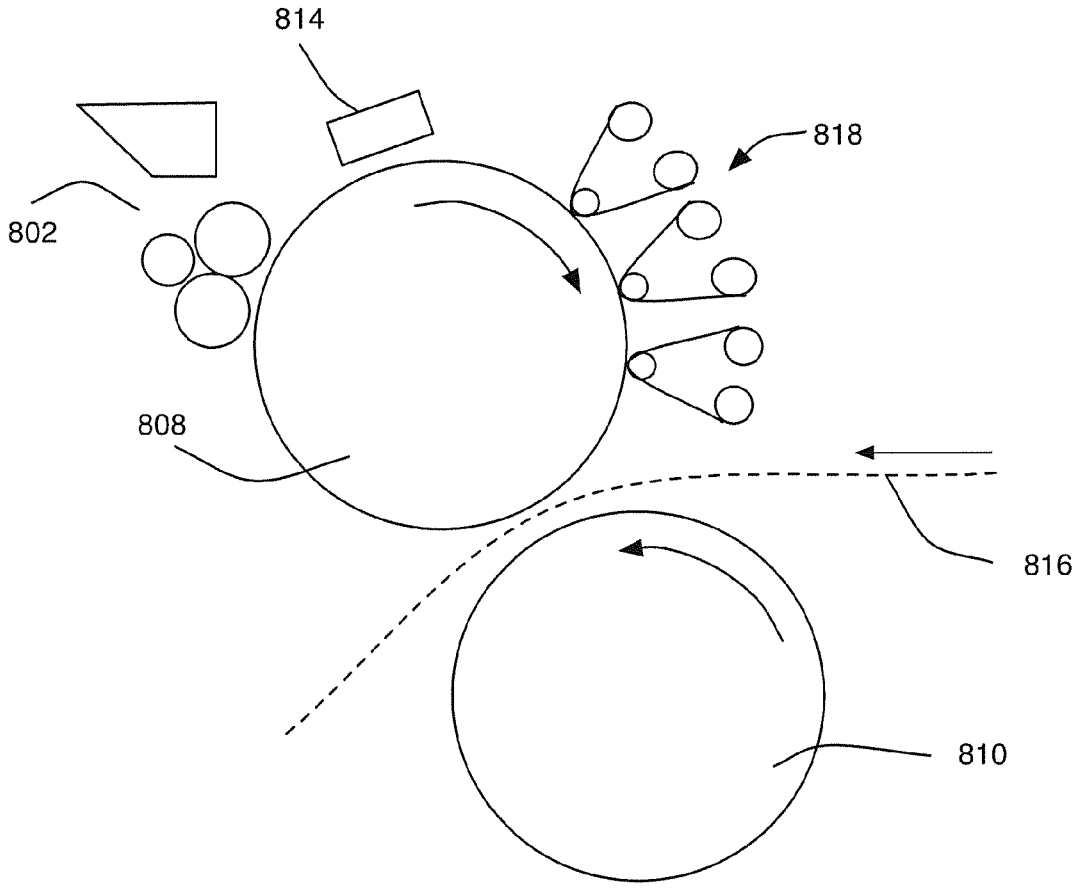

Once the positive image has been protected, rotating imaging cylinder 808 next encounters stripping system 818. Stripping system 818 is used to strip away the ink from the unprotected areas of imaging cylinder 808. In other words, any ink that was not protected by aqueous jet system 814 and is therefore not part of the image to be printed, is stripped away from the imaging cylinder. As shown in FIG. 8A, stripping system 818 may be, for example, a series of blank webs that can be used to pull the unprotected ink away from the imaging cylinder. Stripping system 818 may alternatively employ a reverse form roller as described below. The protected ink image is then transferred to the print medium.

The transfer of the protected ink image may be achieved by transferring both the protective aqueous layer and the protected ink to web 816. Alternatively, stripping system 818 may remove the protective aqueous layer so that the originally protected ink may be transferred to the web without the protective aqueous layer. In some embodiments, stripping system 818 may remove the protective aqueous layer at the same time it removes the unprotected ink (i.e., the ink not covered by the protective aqueous layer), leaving only the originally protected ink to be transferred to web 816. In such an embodiment, a reverse form roller may be used to strip off the unprotected ink and aqueous solution. The reverse form roller may also be used to return the stripped ink to inking system 802. In other words, the unused ink may be recycled by stripping system 818. Any other suitable method may be used to transfer the protected ink image to web 816.

Figure 9:
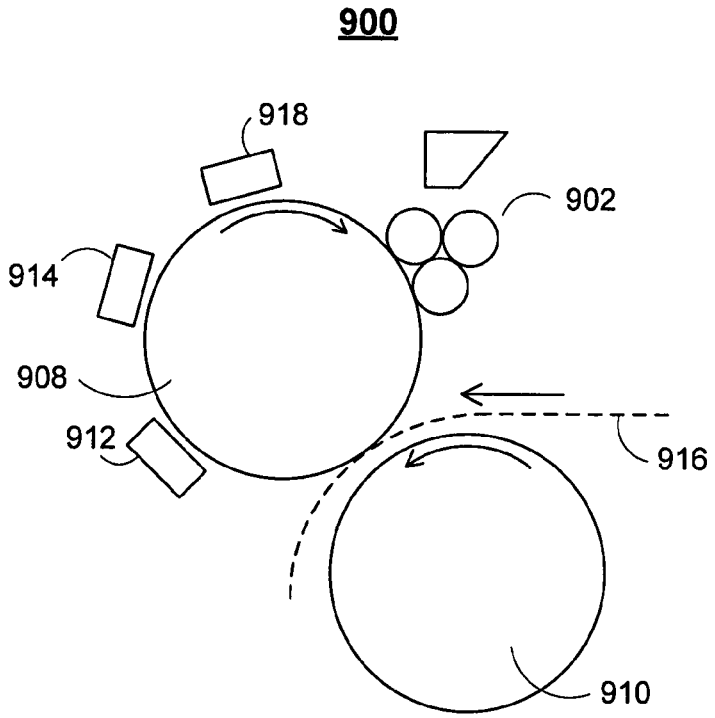
FIG. 9 is a side view of an illustrative embodiment of apparatus in accordance with the principles of the present invention.

Another alternative embodiment of the present invention is illustrated by printing deck 900 of FIG. 9. In embodiments like that shown in FIG. 9, aqueous jet system 914 may be used to print an aqueous solution containing surfactants comprising block copolymers onto imaging cylinder 908. One example of such a surfactant is BASF's Pluronic® F-127 surfactant, which is a block copolymer based on ethylene oxide and propylene oxide. These surfactants may be used to vary the surface properties of imaging cylinder 908 between hydrophilic and lipophilic.

For example, aqueous jet system 914 may be used to print a positive image onto imaging cylinder 908. Then, a heat source, e.g., dryer 918 or any other suitable means of evaporating the water, may be used to dry the aqueous solution. This will leave the block copolymer bonded to imaging cylinder 908 at the location at which it was printed by aqueous jet system 914. The block copolymer should be chosen such that one end bonds with surface material of the imaging cylinder while the other end is lipophilic. If a naturally hydrophilic imaging cylinder is used, the imaging cylinder will be lipophilic everywhere that aqueous jet system 914 printed the block copolymer, and hydrophilic everywhere else. The imaging cylinder may now be used in the known lithographic process. For example, ink may be constantly applied to imaging cylinder 908 by inking system 902. The image may be then be transferred to the print medium (e.g., web 916 between imaging cylinder 908 and impression cylinder 910).

The embodiment of FIG. 9 may also include cleaning system 912. The cleaning system may only selectively engage imaging cylinder 908. Because the block copolymer surfactant has been physically bonded to imaging cylinder 908, it may not be removable by mechanical means. In other words, the imaging cylinder could be used repeatedly, as if it were a standard lithographic plate. When the data system controlling the press determines that information needs to be varied, cleaning system 912 may selectively release some of the block copolymers. For example, a chemical that negates the bond between the block copolymer and the imaging cylinder could be used to remove the block copolymer in select locations. Those of ordinary skill in the art will recognize that any suitable means of releasing the bond between the block copolymer and imaging cylinder 908 may be employed to selectively release the block copolymer. For example, a reducing agent may be used to negate the bond between the block copolymer and imaging cylinder 908.

In an alternative embodiment of FIG. 9, aqueous jet system 914 may print a negative image on imaging cylinder 908. In this embodiment, it may be desirable to use a naturally lipophilic imaging cylinder and a block copolymer surfactant in the aqueous solution that is hydrophilic on its free end, i.e., the end opposite the end bonded to the imaging cylinder. Again, the aqueous solution may be dried to leave only the bonded surfactant, and imaging cylinder 908 may be used repeatedly. As described above, the block copolymer could be selectively removed using cleaning system 912 with an acceptable neutralizing solution at the appropriate time.

In yet another alternative of the FIG. 9 embodiment, charged block copolymer surfactant molecules may be employed so that the bond between imaging cylinder 908 and the surfactant can be electronically controlled. In other words, aqueous jet system 914 may be used to place the charged surfactants at the desired location. The charged properties of the surfactant molecules may be what permits their physical bond to imaging cylinder 908. Thus, removing them may require selectively applying a neutralizing charge from cleaning system 912.

Alternatively, imaging cylinder 908 may have a charged surface that is controllable to change the charged property of a particular point on the imaging cylinder at a particular time. In other words, points on imaging cylinder 908 may be toggled between positively and negatively charged to attract and repel the surfactants at the appropriate time in the printing process.

As evidenced by the above description, surfactant block copolymers having various properties may be used with imaging cylinders having various material properties to achieve an imaging cylinder that has a selectively oleophilic and hydrophilic surface. The physical bond created between the surfactant and the imaging cylinder's surface allows the imaging cylinder to repeat the same image multiple times or to selectively vary the image in any given rotation of the imaging cylinder. By taking advantage of the material properties of the imaging cylinder and the block copolymer surfactants, a durable, yet variable, imaging system having the quality of known lithographic printing techniques may be achieved.

Surfactants like those described above are sold in various forms (e.g., solid, powder, aqueous solution, gel, etc.). Any desirable form may be used in accordance with the principles of the present invention.

Figure 10:
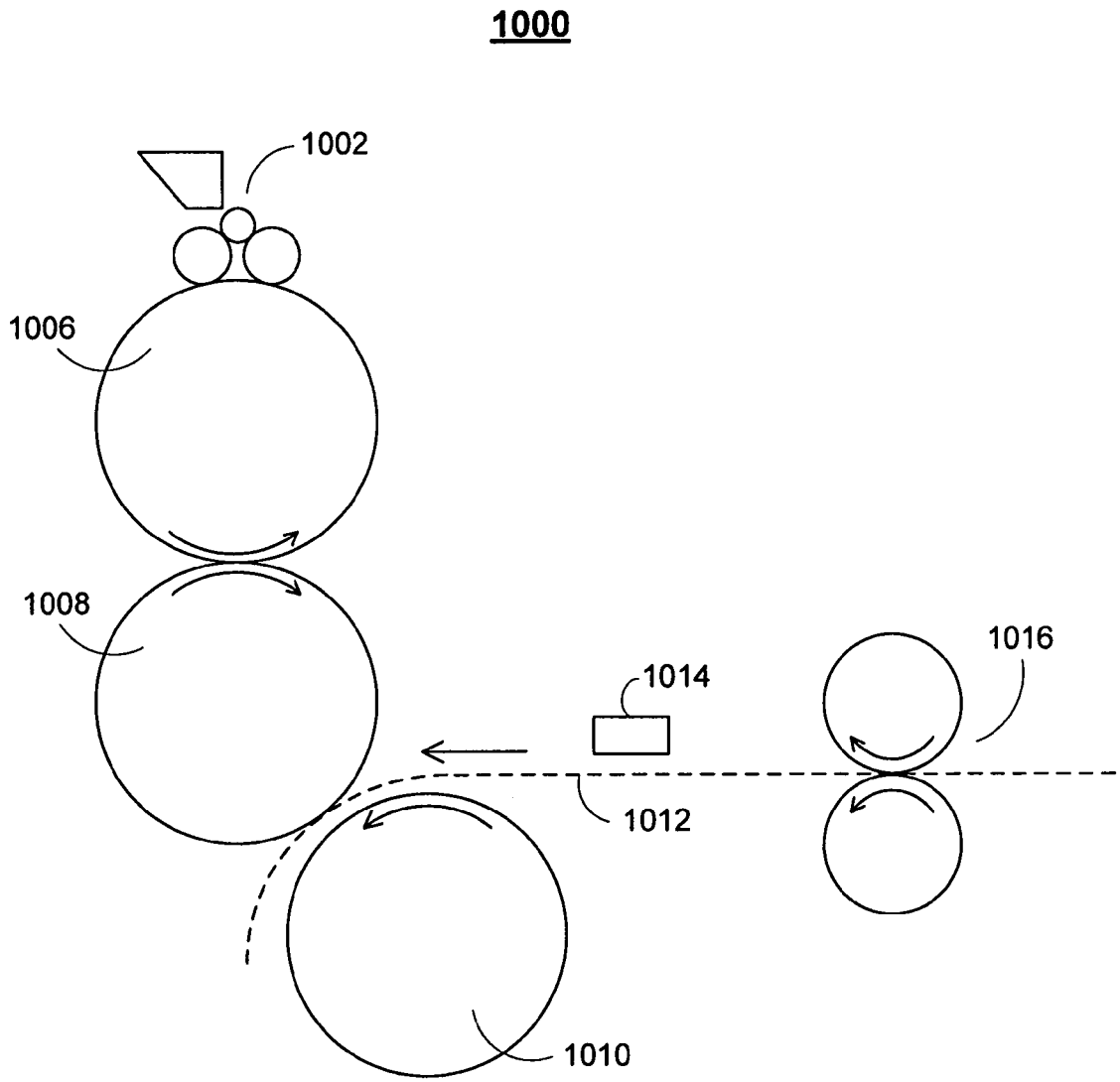
FIG. 10 is a side view of an illustrative embodiment of apparatus in accordance with the principles of the present invention.
Figure 11:
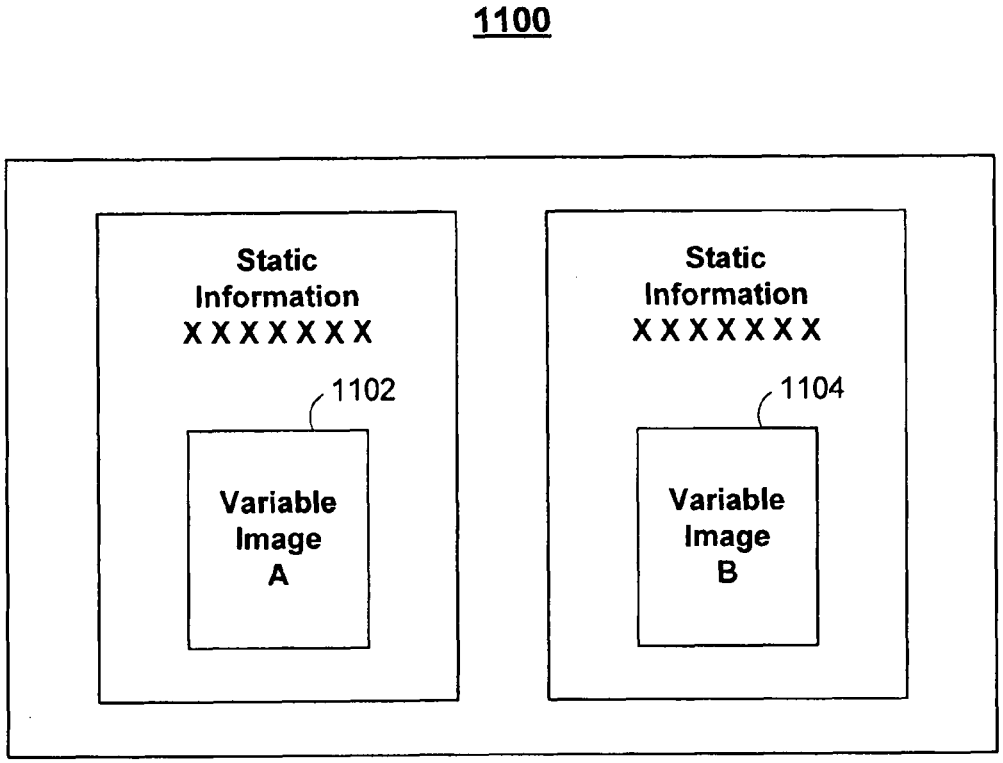
FIG. 11 is an illustration of possible output in accordance with the apparatus shown in FIG. 10 and the principles of the present invention.

FIG. 10 illustrates another alternative embodiment of the present invention. FIG. 10 shows lithographic deck 1000 as known in the art (e.g., inking system 1002, plate cylinder 1006, blanket cylinder 1008, and impression cylinder 1010). However, upstream from lithographic deck 1000, coating system 1016 and aqueous jet system 1014 have been installed. In embodiments like that shown in FIG. 10, a standard lithographic plate may be etched with the static information for a given job. However, a portion of the plate may be reserved for variable information (e.g., plate 1100 may include one or more variable image boxes, such as boxes 1102 and 1104, as shown in FIG. 11). The portion of the lithographic plate that corresponds to the variable image boxes may be formed to be ink receptive over the entire surface of the variable image boxes (i.e., when the variable image box portions of the lithographic plate passes the inking system, the entire rectangular areas will accept ink).

To generate the variable image, a negative image of the variable image may be printed by aqueous jet system 1014 directly onto web 1012. Before web 1012 reaches aqueous jet system 1014, web 1012 may be coated to prevent web 1012 from absorbing the aqueous solution. Thus, when the portion of web 1012 to receive the variable image makes contact with the portion of blanket cylinder 1008 transferring the ink for the variable image, web 1012 selectively receives the ink only in the areas not previously printed on by aqueous jet system 1014. The standard lithographic deck operates as though it is printing the same image repeatedly (e.g., a solid rectangle). However, web 1012, which is first negatively imaged by aqueous jet system 1014, only selectively receives the ink in the solid rectangle on blanket cylinder 1008 to create the variable image on web 1012.

Coating system 1016 may be an entire deck of its own for applying the coating. Alternatively, coating system 1016 may be any suitable alternative for applying a coating to web 1012 to reduce its ability to absorb the aqueous solution. For example, coating system 1016 may include a sprayer that sprays a suitable solution onto web 1012. The solution may prevent web 1012 from absorbing all or some of the aqueous solution.

In any of the foregoing embodiments, a blanket and plate cylinder combination may be replaced by a single imaging cylinder and vice versa. In any case, it may be desirable to pair a soft imaging/blanket cylinder with a hard impression cylinder (e.g., a silicone imaging/blanket cylinder and a steel impression cylinder). Alternatively, a hard imaging/blanket cylinder may be paired with a soft impression cylinder (e.g., a ceramic imaging/blanket cylinder and a rubber impression cylinder).

In some embodiments, it may be desirable to employ a silicone imaging cylinder to create a "waterless" system. In such embodiments, the imaging cylinder may have a silicone surface that is entirely oleophobic. As known in the art of waterless lithography, such cylinders may be developed (e.g., etched) such that portions of the cylinder's surface become oleophilic. Because the silicone is naturally oleophobic, there is no need to wet the cylinder before applying ink to the cylinder's surface. In some embodiments of the present invention employing a silicone imaging cylinder, an aqueous solution may be used that includes silicone-based surfactants or other suitable materials that may be both oleophilic and attracted to the imaging cylinder's silicone surface. Thus, the imaging cylinder may be variably imaged with such an aqueous solution in accordance with the principles of the present invention described herein. If necessary, an appropriate cleaning mechanism may be used to clear any residual aqueous solution or ink from the imaging cylinder.

Multiple decks like those shown in FIGS. 2-10 may be mounted in a series to produce a press. Such an arrangement of multiple printing decks is shown in printing press 1200 of FIG. 12. This may be done, for example, to allow for four color printing. In accordance with the CMYK four color process, each of decks 1202, 1204, 1206, and 1208 is responsible for printing in one of cyan, magenta, yellow, or black. Each of the decks may be controlled by its own raster image processor ("RIP") or controller, such as controllers 1210, 1212, 1214, and 1216. Controllers 1210, 1212, 1214, and 1216 may be implemented in hardware and/or software, for example, as part of a printer driver.

The entire press may be managed by a single data system, such as data system 1218, that controls RIP controllers 1210, 1212, 1214, and 1216, which in turn control decks 1202, 1204, 1206, and 1208, respectively. Data system 1218 may be provided with customer input 1224 via database 1220 and variable data source 1222. Database 1220 may include image data, messages, one-to-one marketing data, etc.

In some embodiments, database 1220 contains all the layout information and static image information for the job to be printed, while variable data source 1222 contains all the variable data. For example, customer input 1224 may provide customer data (e.g., layout and content preferences) to database 1220. Variable data source 1222 may store personalized text (e.g., the customer's name and location) and graphics. Data system 1218 may then access both database 1220 and variable data source 1222 in order to print a job. Database 1220 and variable data source 1222 may include any suitable storage device or storage mechanisms (e.g., hard drives, optical drives, RAM, ROM, and hybrid types of memory). Press 1200 may be fed by roll or sheet input 1226. Output 1228 of the press may also be in the roll or sheet format. Additionally, output 1228 of press 1200 may be fully-bound or may be prepared for optional post-processing.

One or more of the aqueous jet systems, cleaning systems, stripping systems, and vacuum or heating systems described in the embodiments above may be electronically controlled via data system 1218. For example, in a typical usage scenario, data system 1218 may access raster image data (or any other type of image data, including, for example, bitmap data, vector graphics image data, or any combination thereof) from database 1220 and/or variable data source 1222. In some embodiments, the image data may be stored in page description code, such as PostScript, PCL, or any other PDL code. The page description code may represent the image data in a higher level than an actual output bitmap or output raster image. Regardless of how the image data is stored, data system 1218 may cause the aqueous jet system of the present invention to print a negative image representing the image data (or any portion thereof) in aqueous solution to a plate or plate cylinder. In some embodiments, as described above, only the data represented by the variable image data may be printed in aqueous solution on the plate or plate cylinder.

Controlling the entire press from a single data system, such as data system 1218, may enable a user to take advantage of form lag techniques. Form lag relates to the timing of multiple variable printing devices acting on the same document. Certain data may need to be printed by one deck while another portion of data may need to be printed by another deck on the same document. In this respect, it may be beneficial to delay the transmission of data to the latter deck, because the document may pass through several intermediary decks before reaching the latter deck. By efficiently managing form lag, image resolution and placement may be improved.

Figure 13:
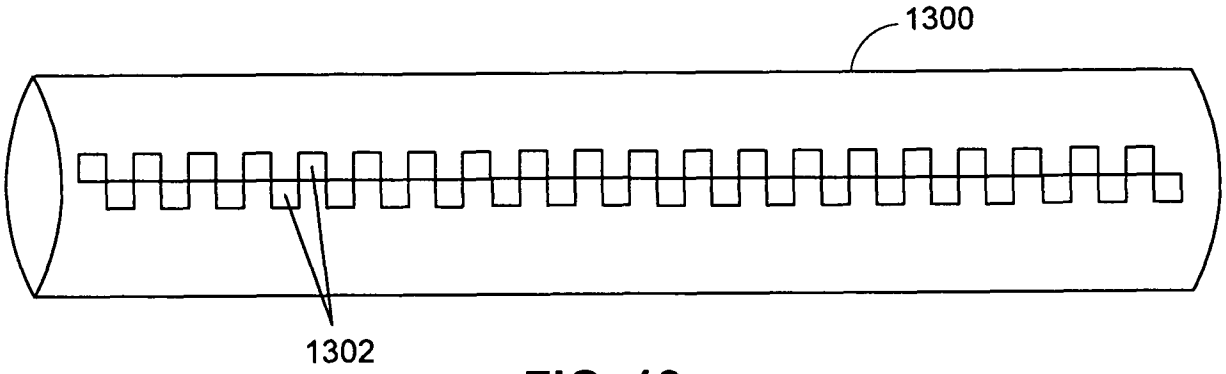
FIG. 13 is an elevational view of a portion of the apparatus shown in FIGS. 2-10.

The aqueous jet systems of the various embodiments of the present invention may be arranged in a number of ways. For example, FIG. 13 illustrates staggered lay-out of individual aqueous jet units 1302 in cylinder 1300. Overlapping the printheads to join the print width of one printhead with the print width of a second printhead is known as stitching. Stitching allows for the precise alignment of multiple printheads so that no noticeable join is visibly detectable.

The aqueous jet units may be known print cartridge units such as those manufactured by HP, Lexmark, Spectra, Canon, etc. Each jet unit may comprise any number of small holes for emitting the aqueous solution. As shown in FIG. 13, aqueous jet units 1302 may overlap one another at the edges in order to avoid any gaps between the aqueous jets. This may ensure that every possible point on the plate cylinder may be imaged.

Figure 14:
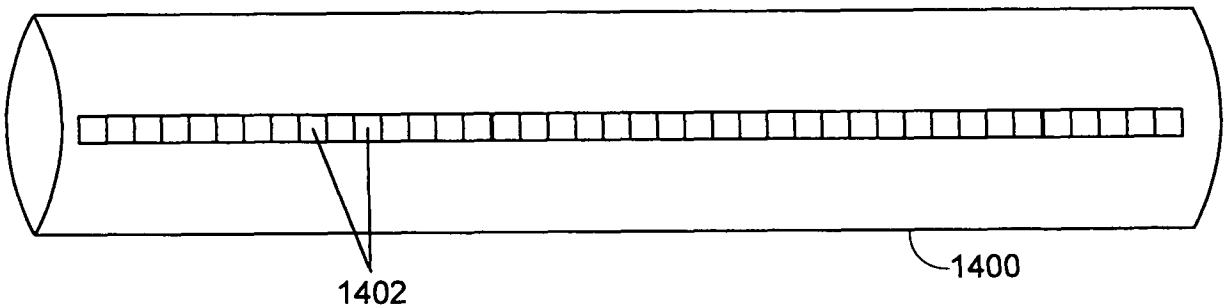
FIG. 14 is an elevational view of a portion of the apparatus shown in FIGS. 2-10.
Figure 15:
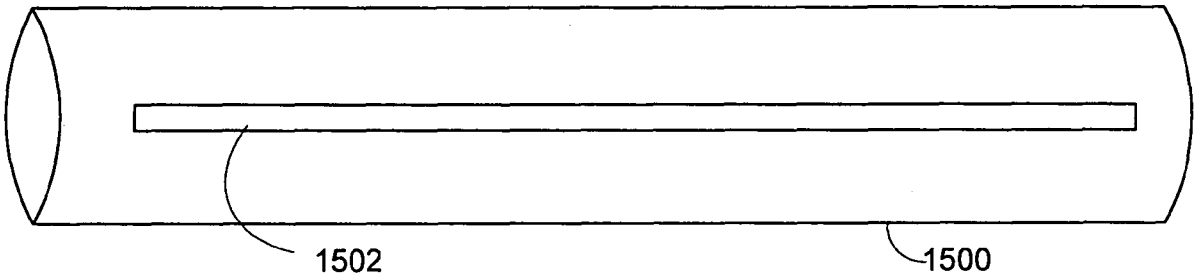
FIG. 15 is an elevational view of a portion of the apparatus shown in FIGS. 2-10.

Alternatively, aqueous jet units 1402 may be arranged in series as shown in cylinder 1400 of FIG. 14. FIG. 15 illustrates another option, in which aqueous jets 1502 are configured as a single unit in cylinder 1500 instead of multiple units. A single unit may ensure that the spacing between each aqueous jet is consistent. Multiple units may be desirable as a means of reducing maintenance and replacement costs. The aqueous jet units may be arranged in any suitable arrangement that enables aqueous solution to be positioned at any point on the plate cylinder or blanket cylinder that is desirable.

Figure 16:
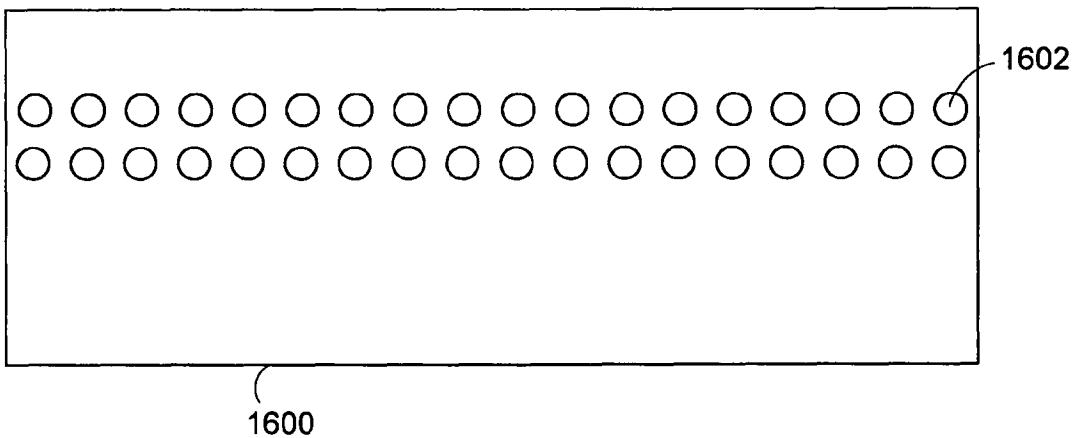
FIG. 16 is an enlarged view of a portion of the apparatus shown in FIGS. 2-10.

FIG. 16 illustrates one example of a possible arrangement of aqueous jets 1602 along aqueous jet unit 1600. Aqueous jets 1602 may be arranged in series, staggered, or arranged in any other suitable way for enabling placing a drop of aqueous solution at any point on the plate cylinder or blanket cylinder.

Figure 17:
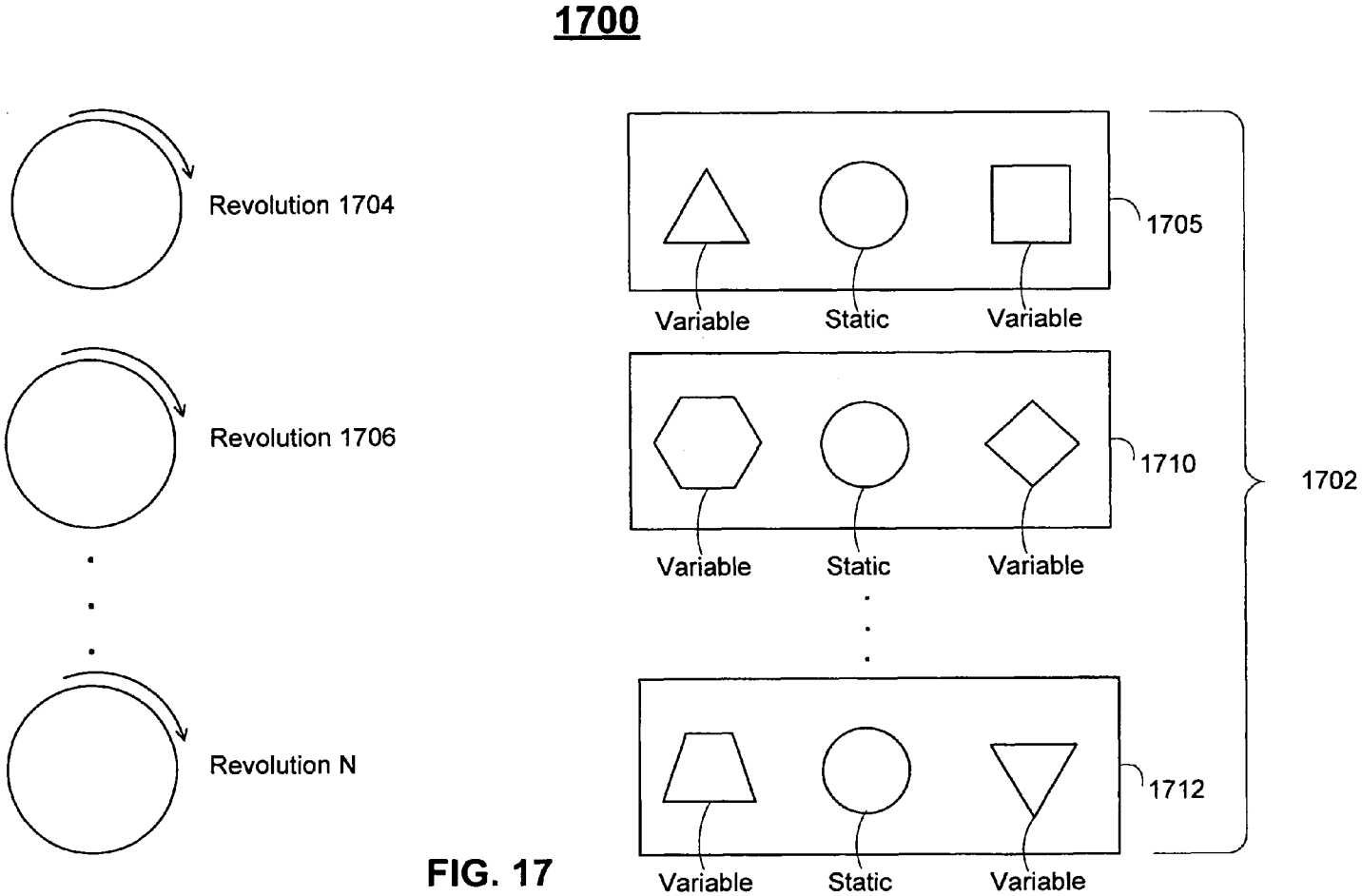
FIG. 17 is an illustration of a possible sequence of output in accordance with the principles of the present invention.

FIG. 17 shows illustrative output 1702 from a press in accordance with the principles of the present invention. Each revolution 1704, 1706, . . . , N of the plate or blanket cylinder may produce, e.g., a document containing one static image and two variable images as shown in documents 1705, 1710, and 1712. Any combination of static and variable information may be produced by such a press. Furthermore, one revolution of the cylinder does not need to match one page of output. Depending on the cylinder size, multiple pages may be printed by the revolution of some cylinders, while the revolution of other cylinders may only produce a portion of an output page.

The high speed variable printing systems and methods of the present invention may be used in a number of lithographic applications. For example, the disclosed systems and methods may be ideal for high-quality one-to-one marketing applications, such as direct mailing, advertisements, statements, and bills. Other applications are also well-suited to the present invention, including the production of personalized books, periodicals, publications, posters, and displays. The high speed variable printing systems and methods of the present invention may also facilitate post-processing (e.g., binding and finishing) of any of the aforementioned products.

It will be understood that the foregoing is only illustrative of the principles of the invention, and that various modifications can be made by those skilled in the art without departing from the scope and spirit of the invention. For example, the order of some steps in the procedures that have been described are not critical and can be changed if desired. Also, various steps may be performed by various techniques.

What is claimed is:

1. A system for printing, comprising:

an inking system to apply ink to a surface;

an aqueous jet system to place individual drops of aqueous solution on the ink wherein placement of each drop is individually controlled;

a stripping system adapted to strip away a first portion of the ink not covered by the aqueous solution from the surface, with a second portion of the ink remaining on the surface; and a transfer system to transfer the second portion of the ink to a print medium.

2. The system of claim 1, wherein the aqueous jet system comprises at least one jet nozzle.

3. The system of claim 1, wherein the aqueous jet system comprises at least one ink jet head.

4. The system of claim 1, wherein the aqueous solution includes ethylene glycol, propylene glycol, or any combination thereof.

5. The system of claim 1, wherein the aqueous solution includes a surfactant.

6. The system of claim 1, wherein the stripping system is configured to pull the ink away from the surface using at least one blank web.

7. The system of claim 1, wherein the stripping system is configured to strip away the ink using a reverse form roller.

8. The system of claim 1, wherein the aqueous solution comprises a gel.

9. The system of claim 1, wherein the placement of each drop is controlled in dependence upon image data representing an image.

10. The system of claim 9, wherein the image data comprises fixed data, semi-fixed data, or variable data, and combinations thereof.

11. The system of claim 1, wherein the transfer system comprises an impression cylinder.

12. The system of claim 1, wherein the surface is a surface of a cylinder.

13. The system of claim 12, wherein the cylinder is a plate cylinder.

14. The system of claim 12, wherein the cylinder is a blanket cylinder.

15. The system of claim 1, wherein the surface is a surface of an endless belt.

16. The system of claim 1, wherein the print medium is a sheet.

17. The system of claim 1, wherein the print medium is a web.

18. The system of claim 1, wherein the print medium comprises paper.

19. A system for variable printing, comprising:

means for applying ink to a surface;

means for covering a portion of the ink with an aqueous solution by emitting individual drops of aqueous solution wherein the emission of each drop is individually controlled to define an image;

means adapted to strip away a first portion of the ink not covered by the aqueous solution from the surface, with a second portion of the ink remaining on the surface; and means for transferring the second portion of the ink to a print medium.

20. The system of claim 19, wherein the means for covering a portion of the ink comprises at least one jet nozzle.

21. The system of claim 19, wherein the means for covering a portion of the ink comprises at least one ink jet head.

22. The system of claim 19, wherein the aqueous solution includes ethylene glycol, propylene glycol, or any combination thereof.

23. The system of claim 19, wherein the aqueous solution includes a surfactant.

24. The system of claim 19, wherein the means for stripping away the ink comprises means for pulling the ink away from the surface.

25. The system of claim 19 wherein the means for stripping away the ink comprises at least one reverse form roller.

26. The system of claim 19, wherein the aqueous solution comprises a gel.

27. The system of claim 19, wherein the emission of each drop is controlled in dependence upon image data representing the image.

28. The system of claim 27, wherein the image data comprises fixed data, semi-fixed data, or variable data, and combinations thereof.

29. The system of claim 19, wherein the surface is a surface of a cylinder.

30. The system of claim 29, wherein the cylinder is a plate cylinder.

31. The system of claim 29, wherein the cylinder is a blanket cylinder.

32. The system of claim 19, wherein the surface is a surface of an endless belt.

33. The system of claim 19, wherein the print medium is a sheet.

34. The system of claim 19, wherein the print medium is a web.

35. The system of claim 19, wherein the print medium comprises paper.

* * * * *